US010532919B2

(12) United States Patent
Hufnagl et al.

(10) Patent No.: US 10,532,919 B2
(45) Date of Patent: Jan. 14, 2020

(54) COLLAPSIBLE PERSONNEL BASKET FOR A CRANE

(71) Applicant: OMAHA STANDARD, LLC, Council Bluffs, IA (US)

(72) Inventors: Mario Hufnagl, Omaha, NE (US); Robert Engdahl, Omaha, NE (US)

(73) Assignee: Omaha Standard, LLC, Council Bluffs, IA (US)

( * ) Notice: Subject to any disclaimer, the term of this patent is extended or adjusted under 35 U.S.C. 154(b) by 81 days.

(21) Appl. No.: 14/634,938

(22) Filed: Mar. 2, 2015

(65) Prior Publication Data

US 2016/0257543 A1 Sep. 8, 2016

(51) Int. Cl.
*B66F 11/04* (2006.01)

(52) U.S. Cl.
CPC ..... *B66F 11/044* (2013.01)

(58) Field of Classification Search
CPC ..... F16M 13/02; B66F 11/044; E04G 5/14; E04G 3/30; E04G 7/28; B65D 43/16
See application file for complete search history.

(56) References Cited

U.S. PATENT DOCUMENTS 1,868,187 A * 7/1932 Avallone ..... A47L 3/02 182/55
3,907,066 A * 9/1975 Newton ..... E04G 3/24 182/112
4,137,996 A 2/1979 Brown
4,179,010 A * 12/1979 Ashworth ..... B66F 11/046 182/2.11
4,418,791 A * 12/1983 Frey-Wigger ..... B66F 11/046 182/150

(Continued)

FOREIGN PATENT DOCUMENTS

CA 2703542 A1 * 11/2010 ..... B66F 11/044
CA 2703542 A1 * 11/2010 ..... B66F 11/044

(Continued)

OTHER PUBLICATIONS

"damper". Dictionary.com Unabridged. Random House, Inc. Jan. 6, 2017. <Dictionary.comhttp://www.dictionary.com/browse/damper>.*

(Continued)

*Primary Examiner* — Katherine W Mitchell
*Assistant Examiner* — Candace L Bradford
(74) *Attorney, Agent, or Firm* — Hodgson Russ LLP

(57) ABSTRACT

A collapsible personnel basket apparatus quickly and easily deploys on the tip of a crane boom and stores in a space-efficient manner when not in use. The basket apparatus has a collapsible spine made up of a plurality of spine segments, a support platform pivotally coupled to a bottom spine segment, a connection member pivotally coupled to a top spine segment and including a coupling portion at a proximal end thereof, an adapter configured for attachment to a crane tip at a distal end of a crane boom, and a foldable rail assembly removably mountable on the spine and/or the support platform. The adapter mates with the coupling portion of the connection member to removably mount the connection member on the crane tip. A related deployment method, spine segment locking mechanism, coupling apparatus, and storage apparatus are also disclosed.

18 Claims, 23 Drawing Sheets

(56) References Cited

U.S. PATENT DOCUMENTS

| | | | | | |
|---|---|---|---|---|---|
| 4,444,416 | A * | 4/1984 | Soderstrom | B66F 11/044 | 280/763.1 |
| 4,518,059 | A * | 5/1985 | Frey-Wigger | B66F 11/046 | 182/2.7 |
| 5,009,284 | A | 4/1991 | Authement, Sr. | | |
| 5,199,845 | A | 4/1993 | Hirashima et al. | | |
| 5,273,239 | A * | 12/1993 | De Parny | H02G 1/02 | 244/118.1 |
| 5,394,956 | A | 3/1995 | Hulse | | |
| 5,435,410 | A * | 7/1995 | Langston | B66C 23/78 | 182/2.6 |
| 5,579,866 | A | 12/1996 | Rowell | | |
| 5,727,645 | A * | 3/1998 | Woodling | B66F 11/046 | 182/2.1 |
| 5,826,859 | A * | 10/1998 | Kononov | B66F 11/046 | 254/134.3 R |
| 8,360,203 | B2 | 1/2013 | Waisanen et al. | | |
| 8,627,925 | B2 | 1/2014 | Webster | | |
| 8,739,928 | B2 * | 6/2014 | Schneider | B66F 11/046 | 182/2.2 |
| 2004/0262079 | A1 * | 12/2004 | Bailey | B66C 23/36 | 182/2.3 |
| 2007/0125599 | A1 * | 6/2007 | Campbell | B66F 11/04 | 182/148 |
| 2009/0096231 | A1 * | 4/2009 | Burlingame | B66F 11/04 | 294/68.3 |

FOREIGN PATENT DOCUMENTS

| | | | | |
|---|---|---|---|---|
| CN | 203333199 | U | 12/2013 | |
| CN | 103723663 | A | 4/2014 | |
| CN | 203639104 | U | 6/2014 | |
| FR | 2876367 | A1 * | 4/2006 | B66F 11/044 |
| FR | 2876367 | A1 * | 4/2006 | B66F 11/044 |
| FR | 2984292 | A1 * | 6/2013 | B66F 11/04 |
| FR | 2984292 | A1 * | 6/2013 | B66F 11/04 |
| WO | WO 2010103014 | A1 * | 9/2010 | B66F 11/044 |
| WO | WO-2010103014 | A1 * | 9/2010 | B66F 11/044 |

OTHER PUBLICATIONS

Decca Industries Ltd., Crane Accessories, web page http://www.deccaindustries.com/for_sale/manbaskets_spreader_bars/, Apr. 18, 2014, pp. 1-5, U.S.A.

R.J. Cox Engineering, Collapsible or Folding Work Platform Forklift Safety Cage, web page http://www.rjcox.com.au/product/2256/42861/collapsible-or-folding-work-platform-forklift-safety-cage, Apr. 18, 2014, pp. 1-2, Australia.

* cited by examiner

COLLAPSIBLE PERSONNEL BASKET FOR A CRANE

FIELD OF THE INVENTION

The present invention relates generally to crane-mounted personnel baskets for supporting workers at a distal end of a crane boom.

BACKGROUND OF THE INVENTION

A problem associated with known personnel baskets is that they are not designed for easy and space-efficient storage when they are not in use. Some baskets on the market are permanently mounted to the lifting device. Other commercially available baskets may be stored on the bed of the mechanic truck, taking up valuable storage space. Still other baskets on the market are mounted on a trailer hitch at the rear of the truck when not in use, thereby creating an obstacle impeding access to other equipment on the truck.

There is a need for a personnel basket that allows for compact storage when not in use, yet is easy to deploy in a few minutes.

SUMMARY OF THE INVENTION

The present invention provides a collapsible personnel basket apparatus that can be quickly and easily deployed on the tip of a crane boom and stored in a space-efficient manner when not in use. The basket apparatus generally comprises a collapsible spine made up of a plurality of spine segments, a support platform pivotally coupled to a bottom spine segment, a connection member pivotally coupled to a top spine segment and including a coupling portion at an end thereof, an adapter configured for attachment to a crane tip at a distal end of a crane boom, wherein the adapter mates with the coupling portion of the connection member to removably mount the connection member on the crane tip, and a foldable rail assembly removably mountable on the spine and/or the support platform. In one embodiment, the spine segments are telescopically adjustable between the spine storage position and the spine deployment position, however folding spine segments may be provided as an alternative.

The invention further relates to a method of setting up and connecting a personnel basket to a crane. The method generally comprises the steps of placing a spine assembly of the personnel basket onto a support surface, wherein the spine assembly is in a collapsed storage position; using the crane to adjust the spine assembly from the storage position to an extended deployment position; attaching a rail assembly of the personnel basket to the spine assembly; and coupling the spine assembly to a boom tip of the crane.

The invention also provides a locking mechanism usable between adjacent spine segments in a telescopically collapsible spine to allow easy set-up and prevent unwanted collapse. The locking mechanism has a locked position, a set-up position, and an unlocked position selectable by a user. As a safety feature, the locking mechanism is designed to resist user attempts to change out of the locked position when the extended spine segments are in compression.

In another aspect of the invention, a coupling apparatus is provided for securely coupling the basket apparatus to a crane boom tip and is embodied in the adapter and the mating connection member. The adapter may include an upper pair of side flanges and a crossbar extending transversely between the upper pair of side flanges, and may also include a lower pair of side flanges. The connection member may include a pair of sidewalls each having an open mouth region sized to receive the crossbar, a latch mounted between the pair of sidewalls for pivotal motion about a transverse pivot axis relative to the pair of sidewalls, and a spring arranged to bias the latch toward a closed position relative to the mouth regions of the pair of sidewalls. The latch may be configured to pivot about the pivot axis toward an open position to allow the crossbar to be inserted into the pair of mouth regions, and may be biased by the spring to return to the closed position when the crossbar is received by the pair of mouth regions. The latch may have a transverse retainer bar spaced from the pivot axis such that when the crossbar is received by the pair of mouth regions and the latch is in the closed position, the retainer bar engages the lower pair of side flanges of the adapter to prevent rotation of the connection member relative to the adapter in a downward rotational direction about the crossbar and to prevent pivotal motion of the latch toward the open position.

Finally, the invention provides a storage apparatus designed to be fully opened and closed from one side. The storage apparatus generally comprises a container defining an internal compartment and an access opening for allowing access to the internal compartment, a primary cover primary cover movable relative to the container between a closed position in which the primary cover closes a first portion of the access opening and an open position in which the primary cover does not close the first portion of the access opening, a secondary cover movable relative to the container between a closed position in which the secondary cover closes a second portion of the access opening and an open position in which the secondary cover does not close the second portion of the access opening, and a transmission mechanically connecting the primary cover to the secondary cover. The transmission acts so that motion of the primary cover from its closed position to its open position moves the secondary cover from its closed position to its open position, and so that motion of the primary cover from its open position to its closed position moves the secondary cover from its open position to its closed position.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

Figure 1:
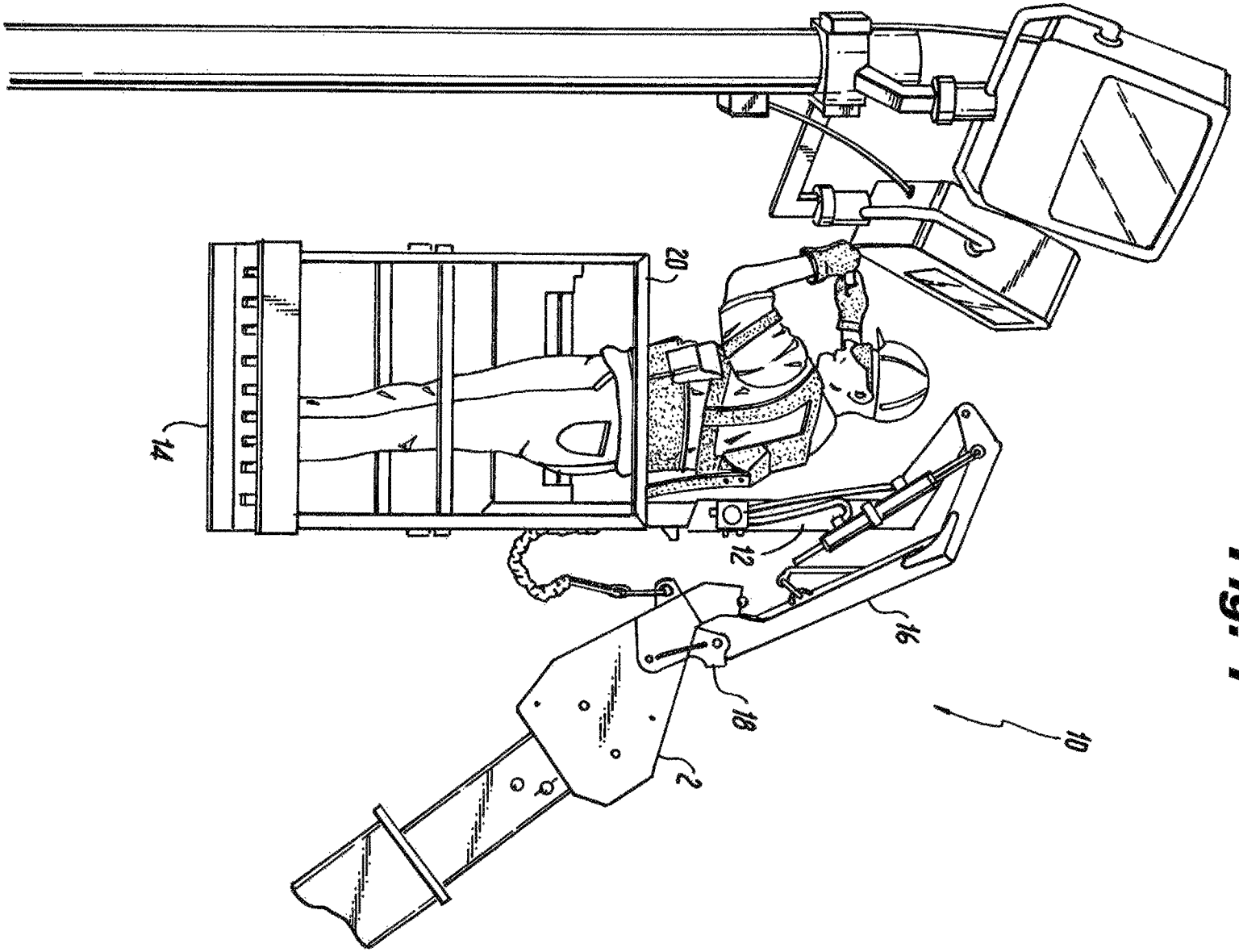
FIG. 1 is a perspective view showing a personnel basket apparatus formed in accordance with an embodiment of the present invention, wherein the apparatus is deployed on a truck-mounted crane.
Figure 2:
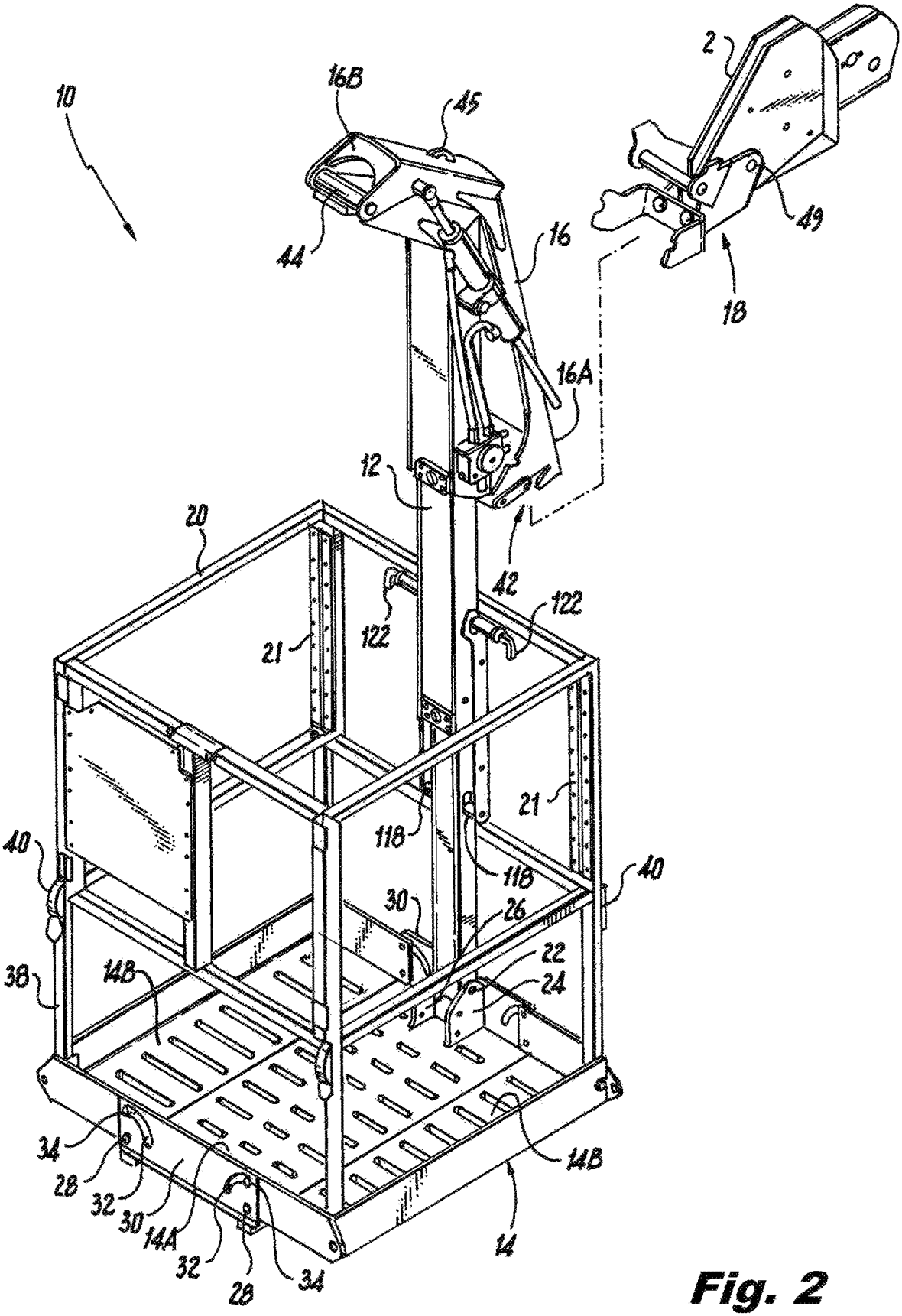
FIG. 2 is perspective view of a personnel basket apparatus formed in accordance with an embodiment of the present invention.
Figure 3:
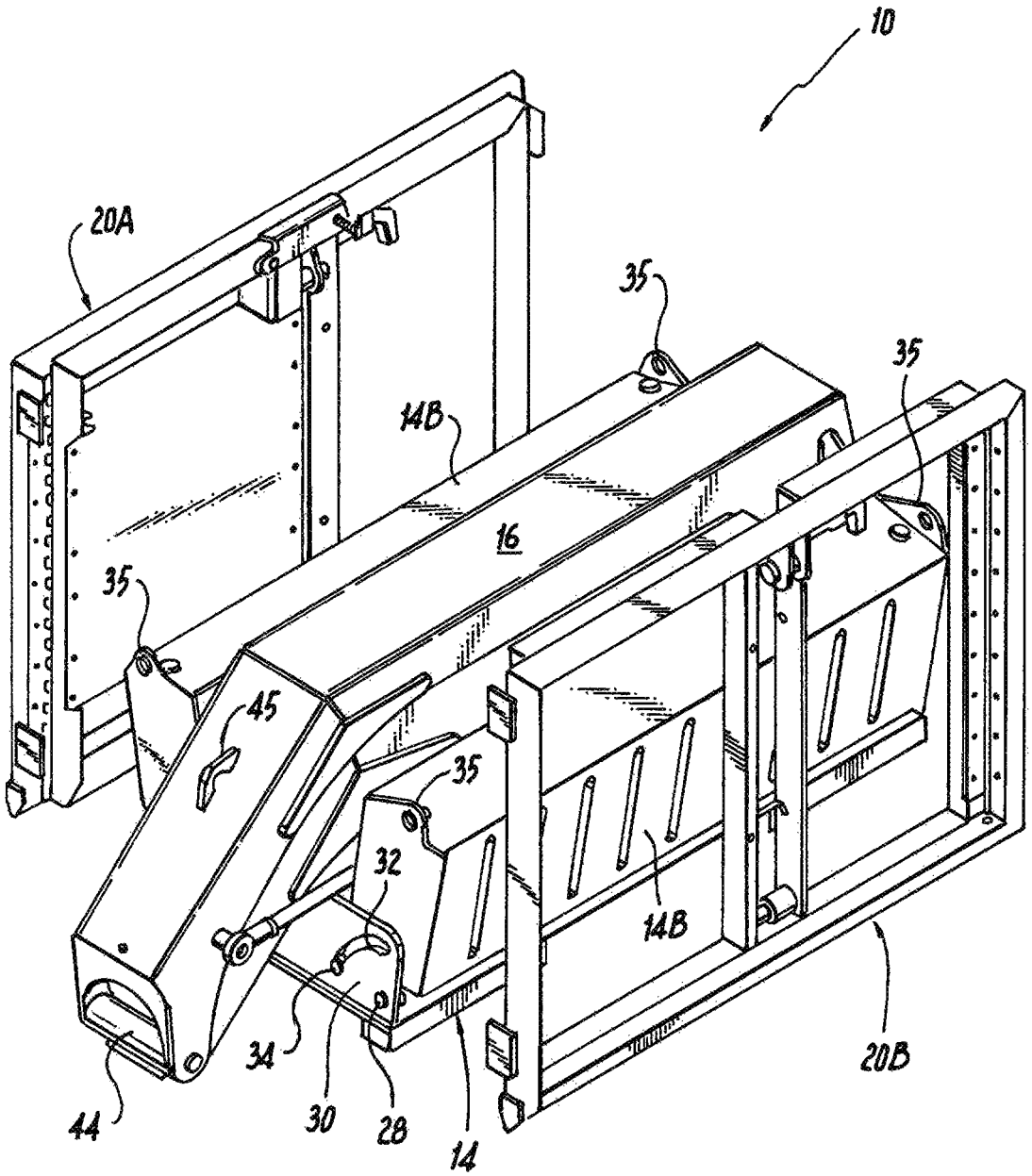
FIG. 3 is another perspective view of the personnel basket apparatus shown in FIG. 1, wherein the apparatus is shown in a collapsed storage position.

In FIGS. 1-3, a personnel basket apparatus formed in accordance with an embodiment of the present invention is broadly identified by reference numeral 10. Basket apparatus 10 is attachable to a boom 2 of a crane to safely support and lift a worker so that the worker may perform tasks with respect to elevated structures such as roadwork/construction, mining, agricultural equipment as well as buildings, and the like. Basket apparatus 10 generally comprises a collapsible spine 12, a foldable support platform 14, a connection member 16, an adapter 18 mounted at a tip of crane boom 2, and a foldable rail assembly 20.

Figure 5:
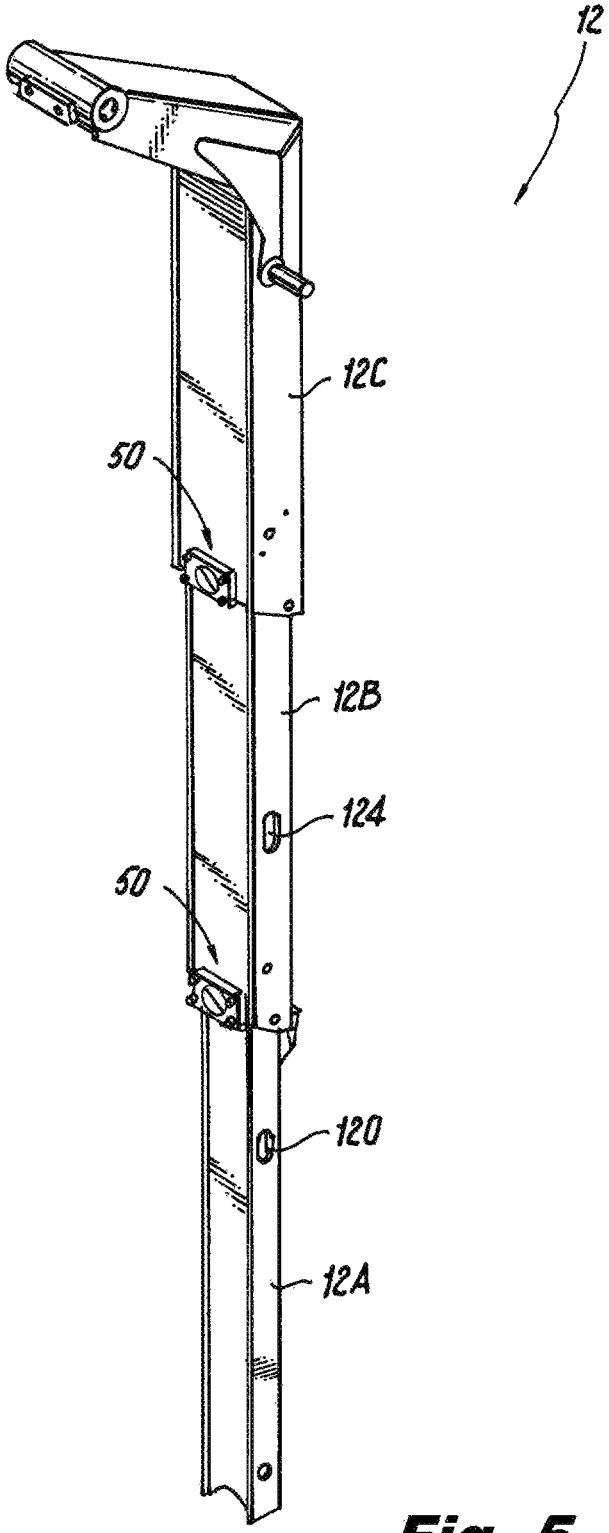
FIG. 5 is a generally front perspective view showing a spine of the personnel basket apparatus.
Figure 6:
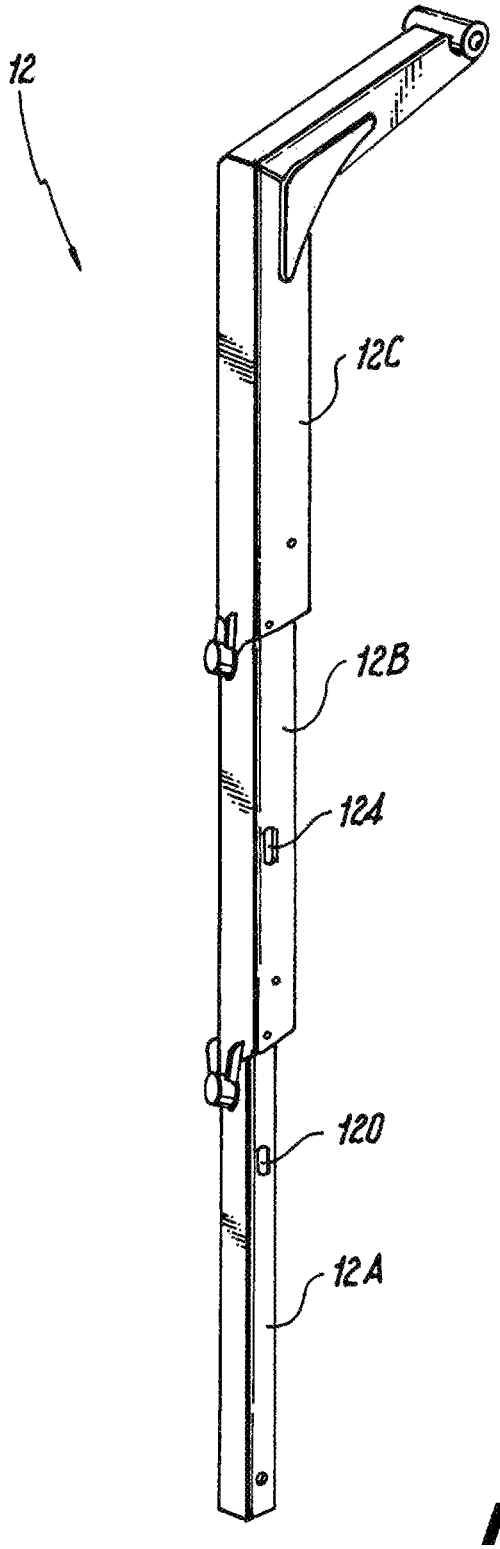
FIG. 6 is a generally rear perspective view showing the spine of the personnel basket apparatus.

Spine 12, shown in isolation in FIGS. 5 and 6, includes a plurality of elongated spine segments 12A, 12B, and 12C adjustable between a spine storage position (for example, as shown in FIG. 3) wherein the spine segments 12A, 12B, 12C overlap one another, and a spine deployment position (for example, as shown in FIGS. 1 and 2) wherein the plurality of spine segments 12A, 12B, 12C are arranged end-to-end with one another. While the drawing figures show a bottom spine segment 12A, a middle spine segment 12B, and a top spine segment 12C, it will be understood that the invention may be practiced with as few as two spine segments or with more than three spine segments. Regardless of how many spine segments are provided, spine 12 will include at least a bottom spine segment adjacent support platform 14 and a top spine segment adjacent connection member 16. In the illustrated embodiment, the plurality of spine segments 12A, 12B, 12C are telescopically adjustable between the spine storage position and the spine deployment position. For example, bottom spine segment 12A is slidable into middle spine segment 12B, which is slidable into top spine segment 12C. While spine 12 is illustrated as having telescopically adjustable segments, it is also contemplated to provide pivot joints connecting ends of adjacent spine segments, whereby the spine segments would be foldable into a spine storage position in which the segments overlap one another and unfoldable into a spine deployment position in which the segments are arranged end-to-end with one another. In the embodiment shown, an upper end of top spine segment 12C is angled in "dog leg" fashion relative to the rest of spine 12.

In an aspect of the present invention applicable to telescopically adjustable spine segments, a locking mechanism 50 may be provided at each connection between overlapping ends of adjacent spine segments. For example, in the illustrated embodiment having three spine segments 12A, 12B, and 12C, a locking mechanism 50 is provided between adjacent spine segments 12A and 12B, and another locking mechanism 50 is provided between adjacent spin segments 12B and 12C. As will be understood later when the procedures for setting up and taking down basket apparatus 10 are described, locking mechanism 50 helps improve safety by preventing unintended collapse of spine 12. Locking mechanism 50 will now be described with reference to FIGS. 7-10.

Figure 7A:
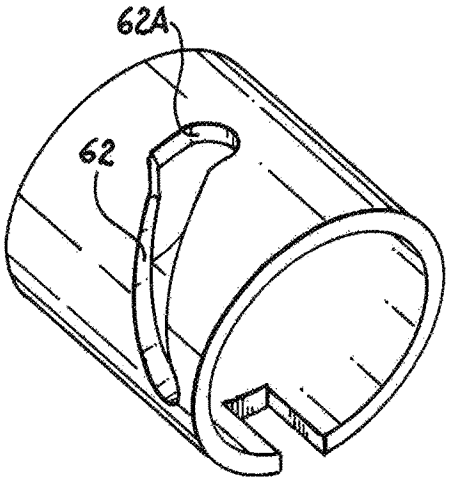
FIG. 7A is an enlarged perspective view of a sleeve of the locking mechanism shown in FIG. 7.
Figure 7:
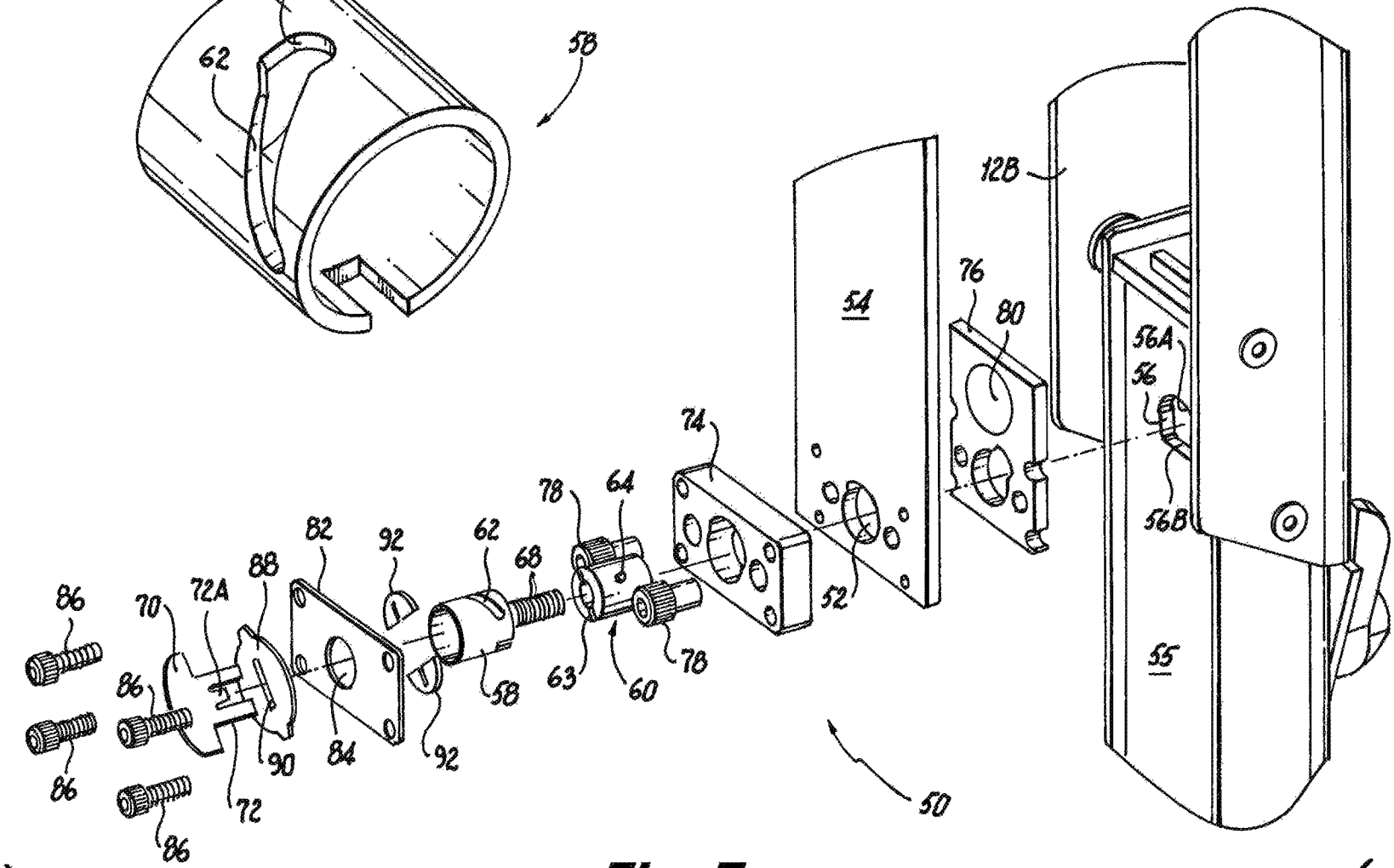
FIG. 7 is an exploded perspective view of a locking mechanism of the spine shown in FIGS. 5 and 6.

FIG. 7 is an exploded view showing the constituent parts and features of locking mechanism 50. Locking mechanism 50 comprises a first segment including a transverse (i.e. non-longitudinal) passageway 52 through a wall 54 thereof, and a second segment slidably received by the first segment for longitudinal adjustment relative to the first segment, wherein the second segment has a shaped feature 56. For example, and as shown in FIG. 7, the first segment may be embodied by spine segment 12B, and the second segment may be embodied by spine segment 12A. As another example, the first segment may be embodied by spine segment 12C, and the second segment may be embodied by spine segment 12B.

Locking mechanism 50 also comprises a cylindrical sleeve 58 arranged in passageway 52 of the first segment and a cylindrical plunger 60 received in sleeve 58 for movement in an inward direction toward the second segment and an outward direction away from the second segment. Sleeve 58 includes a helical groove 62, and plunger 60 has a radially protruding pin 64 engaging helical groove 62 in sleeve 58 such that rotation of plunger 60 in a first rotational direction is accompanied by movement of plunger 60 in the inward direction, and counter-rotation of plunger 60 in a second rotational direction is accompanied by movement of plunger 60 in the outward direction. Plunger 60 also has an inner end portion 66 configured to mate with shaped feature 56 of the second segment.

Locking mechanism 50 further comprises a spring 68 biasing plunger 60 in the inward direction, and a knob 70 connected to plunger 60 for enabling a user to rotate plunger 60 in the first and second rotational directions mentioned above.

Figure 8:
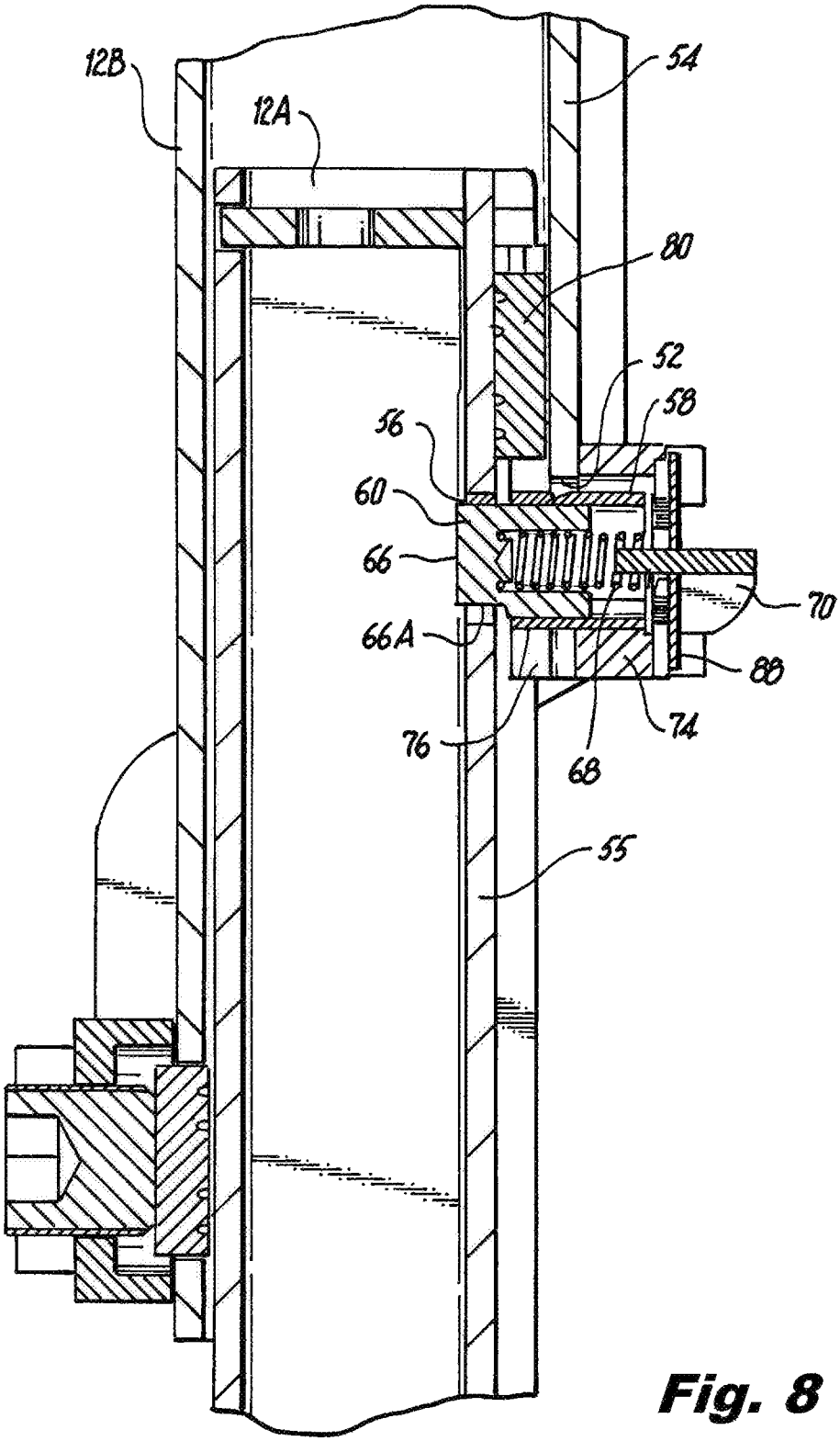
FIG. 8 is a cross-sectional view of the locking mechanism in a locked position.

As will be understood from FIG. 8, knob 70 and plunger 60 are rotatable in the first rotational direction to a locked position wherein the inner end portion 66 of plunger 60 and shaped feature 56 of the second segment mate with one another to restrict longitudinal adjustment of the second segment relative to the first segment. In this locked position, the inner end portion 66 of plunger 60 and the shaped feature 56 are configured to resist rotation of plunger 60 in the second rotational direction when the first segment is in longitudinal compression with the second segment. However, inner end portion 66 and the shaped feature 56 are also configured to allow rotation of plunger 60 in the second rotational direction when the first segment is in longitudinal tension with the second segment. In the illustrated embodiment, shaped feature 56 of the second segment is a recess having a round region 56A connected to a flat region 56B, and the inner end portion 66 of plunger 60 has a flat region 66A. When the first segment is in longitudinal compression with the second segment, the flat region 66A of plunger 60 engages the flat region 56B of the recess to resist rotation of plunger 60 in the second rotational direction. By contrast, when the first segment is in longitudinal tension with the second segment, the flat region 66A of plunger 60 is removed from engagement with the flat region 56B of the recess to allow rotation of plunger 60 in the second rotational direction.

Figure 9:
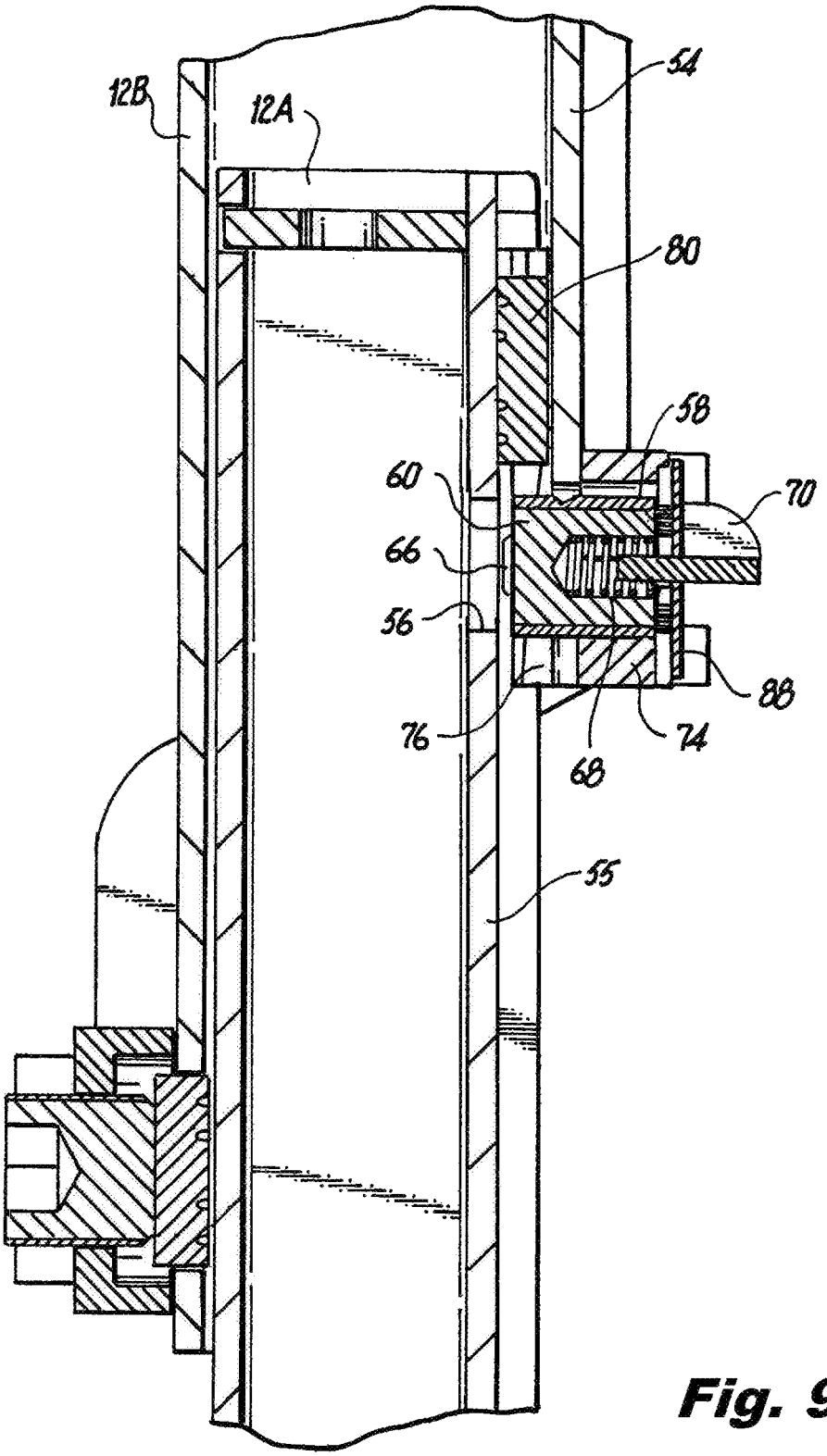
FIG. 9 is a cross-sectional view of the locking mechanism in an unlocked locked position.
Figure 10:
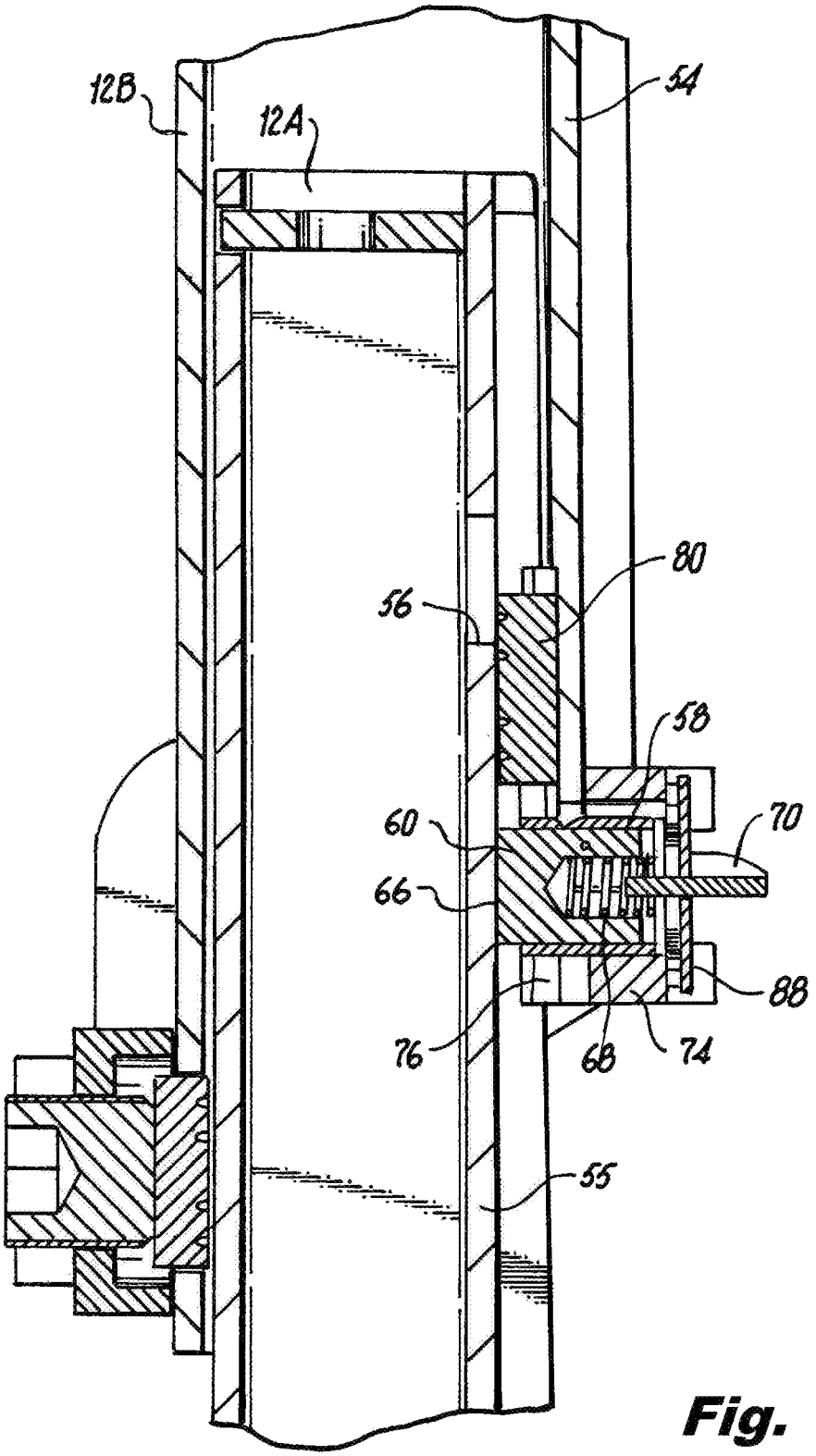
FIG. 10 is a cross-sectional view of the locking mechanism in a set-up position.
Figure 11:
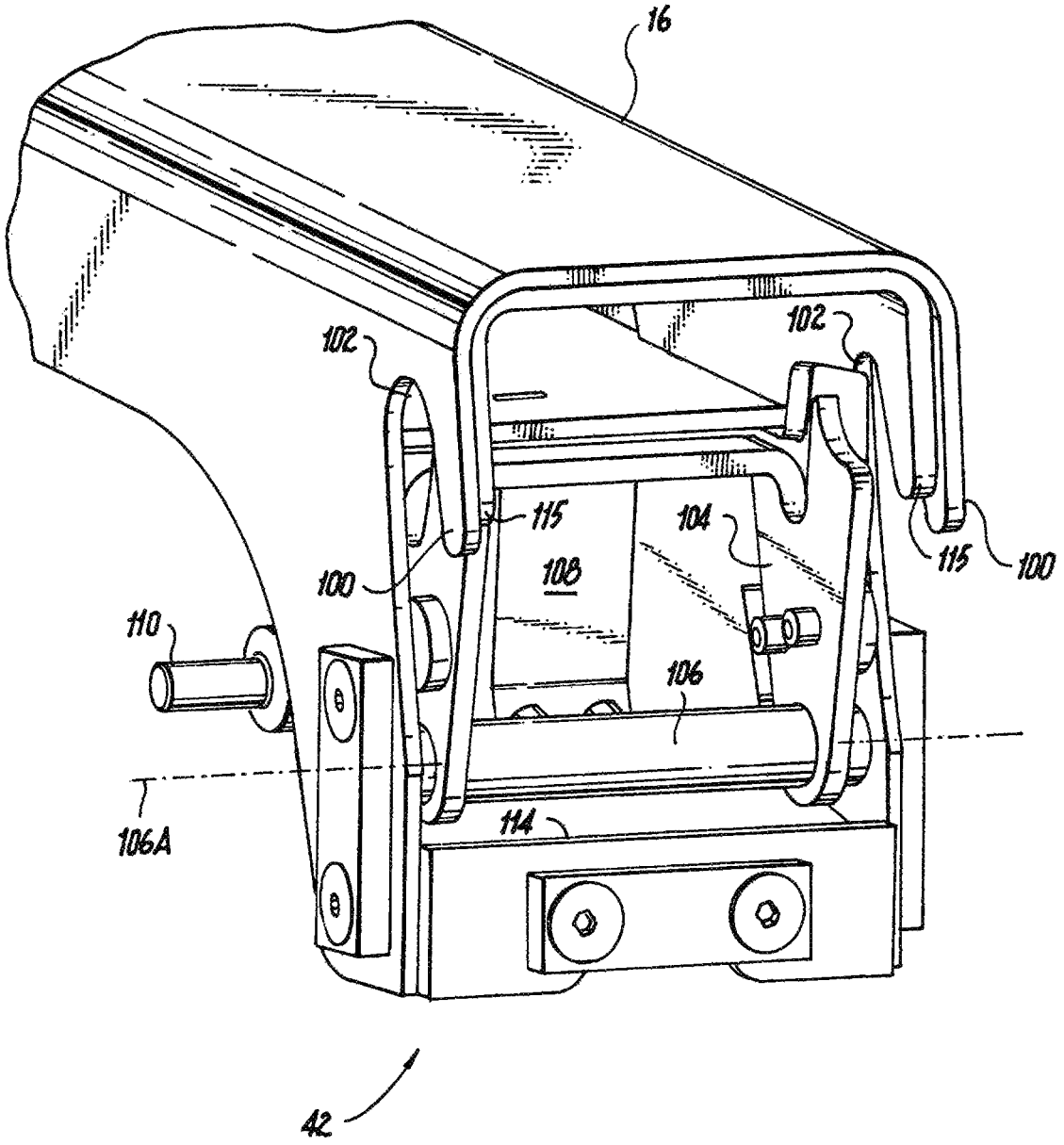
FIG. 11 is a perspective view showing a proximal end of a connection member of the personnel basket apparatus.
Figure 12:
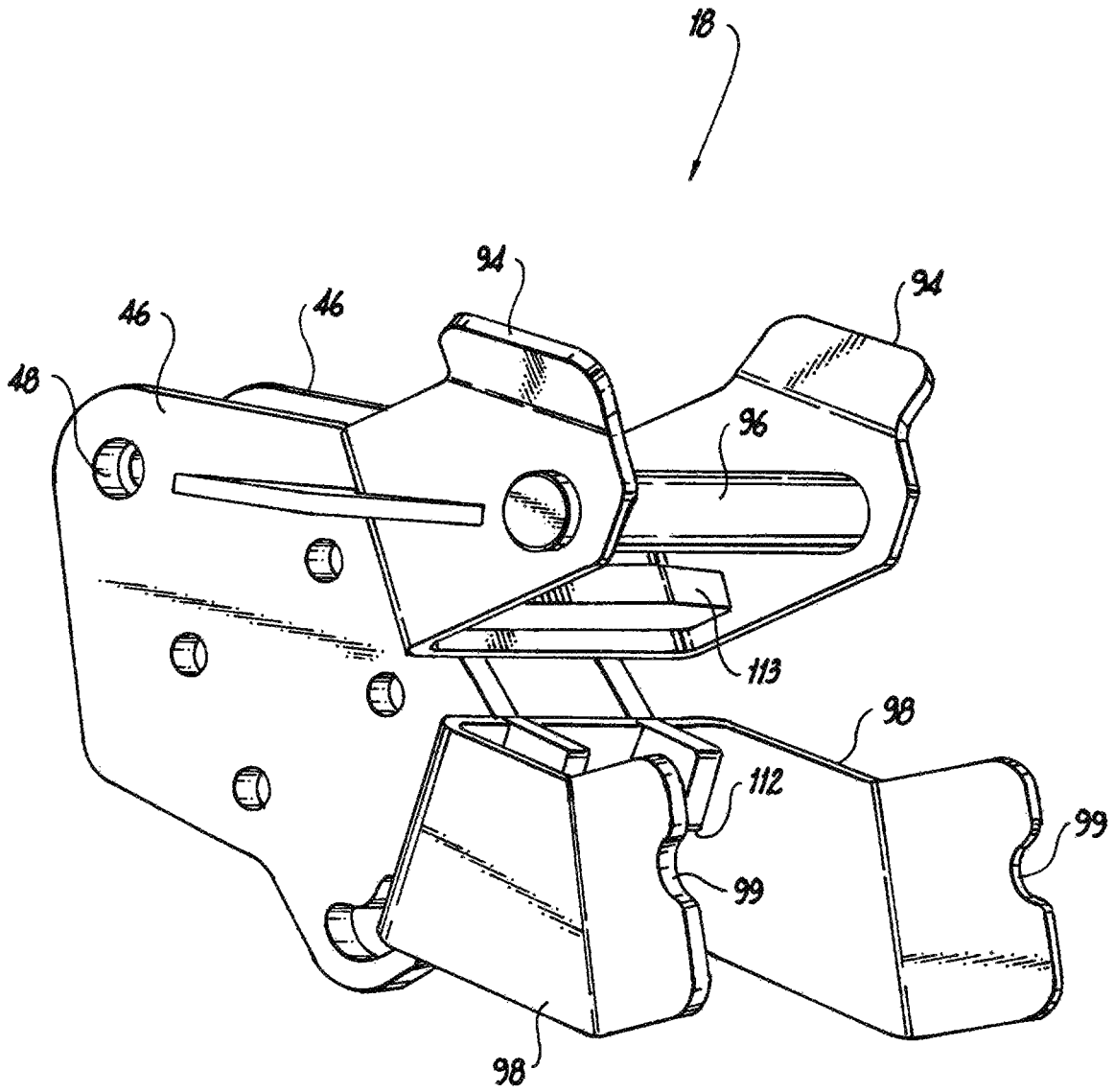
FIG. 12 is a perspective view of an adapter of the personnel basket apparatus for coupling the apparatus to a crane boom.

As shown in FIG. 7A, helical groove 62 may include a circumferential extension 62A at a fixed axial position along sleeve 58. Knob 70 and plunger 60 are rotatable in the second rotational direction to an unlocked position such that pin 64 of plunger 60 is received in groove extension 62A to keep the inner end portion 66 of plunger 60 out of mating engagement with shaped feature 56 of the second segment against the bias of spring 68 to thereby allow longitudinal adjustment of the second segment relative to the first segment. This unlocked condition is illustrated in FIG. 9.

Knob 70 and plunger 60 may also be rotated in the second rotational direction to a set-up position between the locked and unlocked positions described above. In the set-up position, pin 64 of plunger 60 is out of the circumferential extension 62A of helical groove 62 and plunger 60 is biased by spring 68 such that the inner end portion 66 of plunger 60 engages an opposing wall 55 of the second segment and is spring-loaded to enter into mating engagement with the shaped feature 56 of the second segment when the plunger becomes aligned with the shaped feature of the second segment during telescopic extension.

In order to allow knob 70 and plunger 60 to rotate together with one another, yet also allow plunger 60 to move axially relative to knob 70, plunger 60 may include a slot 63 that opens through an outer end of the plunger, and knob 70 may include a tab 72 slidably received in slot 63. When knob 70 is rotated, plunger 60 rotates with knob 70 and moves axially relative to knob 70 as pin 64 is guided by helical slot 62.

Transverse passageway 52 may extend through an outer block 74, wall 54, and an inner plate 76. Countersunk threaded fasteners 78 may be arranged to clamp outer block 74 and inner plate 76 to outer and inner surfaces of wall 54, respectively. Inner plate 76 may include a resilient pad 80 for engaging the second segment as it slides telescopically within the first segment to help maintain axial alignment of the adjustable segments (other resilient pads may be provided on other internal surfaces of the first segment for the same purpose). A cover plate 82 having a central hole 84 may be provided between knob 70 and outer block 74, wherein the cover plate and outer block are fixed to the outer surface of wall 54 by threaded fasteners 86. In the illustrated embodiment, a dial pointer 88 is situated between knob 70 and cover plate 82 and has a slot 90 for receiving tab 72 such that the dial pointer rotates with knob 70. Cover plate 82 may be printed with indicia such as "Locked," "Set-Up" and "Unlocked" corresponding to the rotational positions of knob 70 and dial pointer 88. Tab 72 may have a central tab portion 72A received by an end of spring 68 to help maintain axial alignment of the spring. A pair of retainer clip halves 92 may be arranged to engage notches in tab 72 to prevent knob 70 from being axially withdrawn from the locking mechanism assembly.

Attention returns now to FIGS. 1-3. Support platform 14 is pivotally coupled to bottom spine segment 12A to rotate relative to bottom spine segment 12A between a platform storage position (for example, as shown in FIG. 3) wherein platform 14 overlaps with bottom spine segment 12A and a platform deployment position (for example, as shown in FIGS. 1 and 2) wherein platform 14 is substantially perpendicular to bottom spine segment 12A. Support platform 14 may be pivotally coupled to bottom spine segment 12A by a horizontal pivot pin 22 extending through a pair of spaced bracket members 24 on platform 14 and through a bottom end portion of the spine segment received between bracket members 24. Relative rotation between platform 14 and bottom spine segment 12A may be limited by a pair of stop plates 26 respectively fixed to an inner surface of each bracket member 24, only one stop plate 26 being visible in the figures. As may be understood, rotation of platform 14 relative to bottom spine segment 12A may be limited such that the support surface of platform 14 is normal to spine 12 when spine 12 and platform 14 are lifted from the ground.

Support platform 14 may comprise a plurality of platform portions hingedly connected to one another, wherein the platform portions are folded relative to one another when the platform is in the platform storage position and the platform portions are unfolded relative to one another when the platform is in the platform deployment position. In the depicted embodiment, support platform 14 includes a central platform portion 14A pivotally coupled to bottom spine segment 12A by pivot pin 22, and a pair of lateral platform portions 14B hingedly coupled to central platform portion 14A on opposite sides thereof. For example, hinge pins 28 may be provided for folding connection of lateral platform portions 14B to central platform portion 14A, and upstanding end plates 30 on central platform portion 14A may be provided with arcuate limit slots 32 arranged to receive limit pins 34 carried by upstanding end plates 36 on lateral platform portions 14B that overlap with end plates 30 on central platform portion 14A, whereby the lateral platform portions 14B unfold to a resting position that is substantially coplanar with central platform portion 14A. The outer corners of lateral platform portions 14B may be provided with harness eyelets 35 for hoisting purposes.

Support platform 14 may include a plurality of support posts 38 foldable from a horizontal storage position to a vertical deployment position, shown in FIG. 2, wherein the support posts 38 provide support for foldable rail assembly 20, for example at each corner of the rail assembly. Support posts 38 may each include a spring-loaded toggle clip 40 for securing the support post to rail assembly 20.

Connection member 16 includes a proximal end 16A and a distal end 16B. proximal end 16A has a coupling portion 42 used to attach connection member 16 to the tip of crane boom 2. Distal end 16B is pivotally coupled to top spine segment 12C to rotate relative to the top spine segment. In the embodiment shown, a rotational journal 44 provides pivotal coupling between distal end 16B and top spine segment 12C. Distal end 16B may be angled in "dog leg" fashion relative to the remainder of connection member 16 in a manner corresponding to the dog leg bend in top spine segment 12C. An eyelet member 45 may be fixed to an upper surface of connection member 16 for use in deploying basket apparatus 10 as will be explained in greater detail below.

Adapter 18 is configured for attachment to the distal tip of crane boom 2. For example, adapter 18 may have a pair of side plates 46 spaced apart to mount in flush surface-to-surface engagement against the sides of the crane tip, and aligned retention pin holes 48 through side plates 46 for receiving a pin 49 extending through side plates 46 and the tip of the crane boom. For example, pin 49 may be the same pin that rotatably supports a hoist pulley (not visible) at the tip of crane boom 2. Side plates 46 may also include bolt holes registering with corresponding holes in the crane boom tip for attaching adapter 18 to the crane boom tip with threaded fasteners. Adapter 18 mates with the coupling portion 42 of connection member 16 to form a coupling apparatus for removably mounting the connection member 16 on the crane boom tip.

The coupling apparatus embodied by coupling portion 42 of connection member 16 in combination with mating adapter 18 will now be described with reference to FIGS. 11-15.

Adapter 18 includes an upper pair of side flanges 94 and a crossbar 96 extending transversely between the upper pair of side flanges 94. Adapter 18 further includes a lower pair of side flanges 98.

The coupling portion 42 of connection member 16 includes a pair of sidewalls 100 each having an open mouth region 102 sized to receive crossbar 96 of adapter 18. Coupling portion 42 also includes a latch 104 mounted between the pair of sidewalls 100 for pivotal motion about a transverse pivot axis 106A defined by an axle 106 extending between sidewalls 100.

Figure 13:
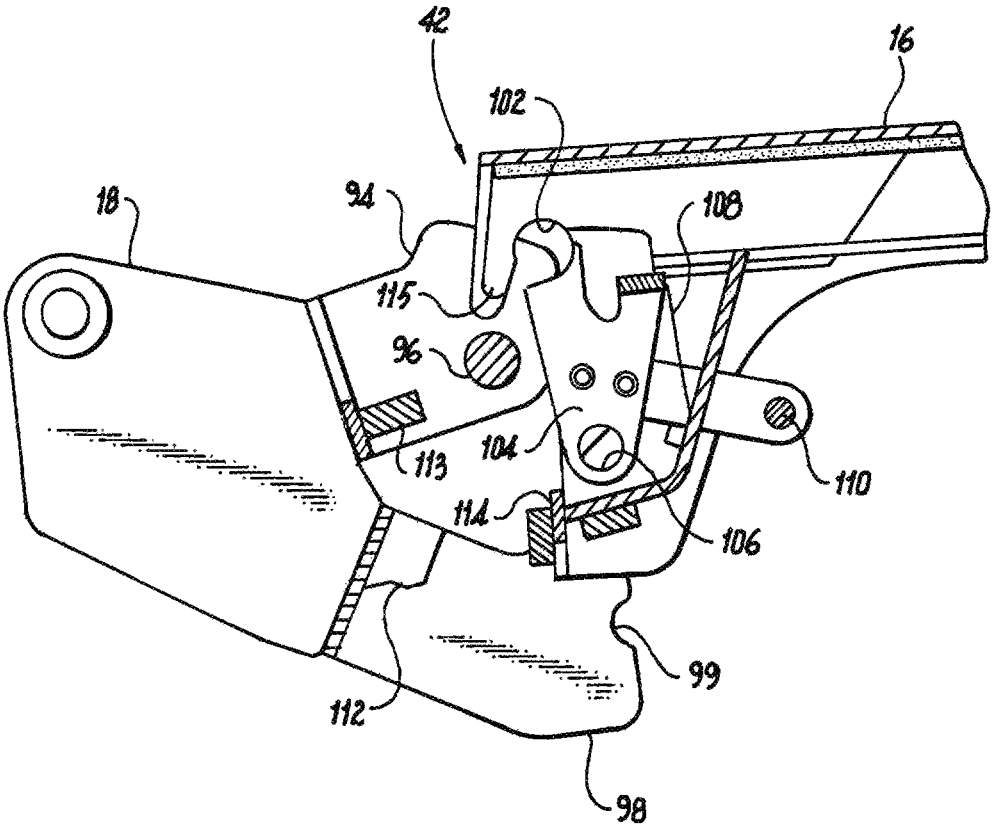
FIG. 13 is a cross-sectional view showing the connection member and adapter just prior to mating.
Figure 14:
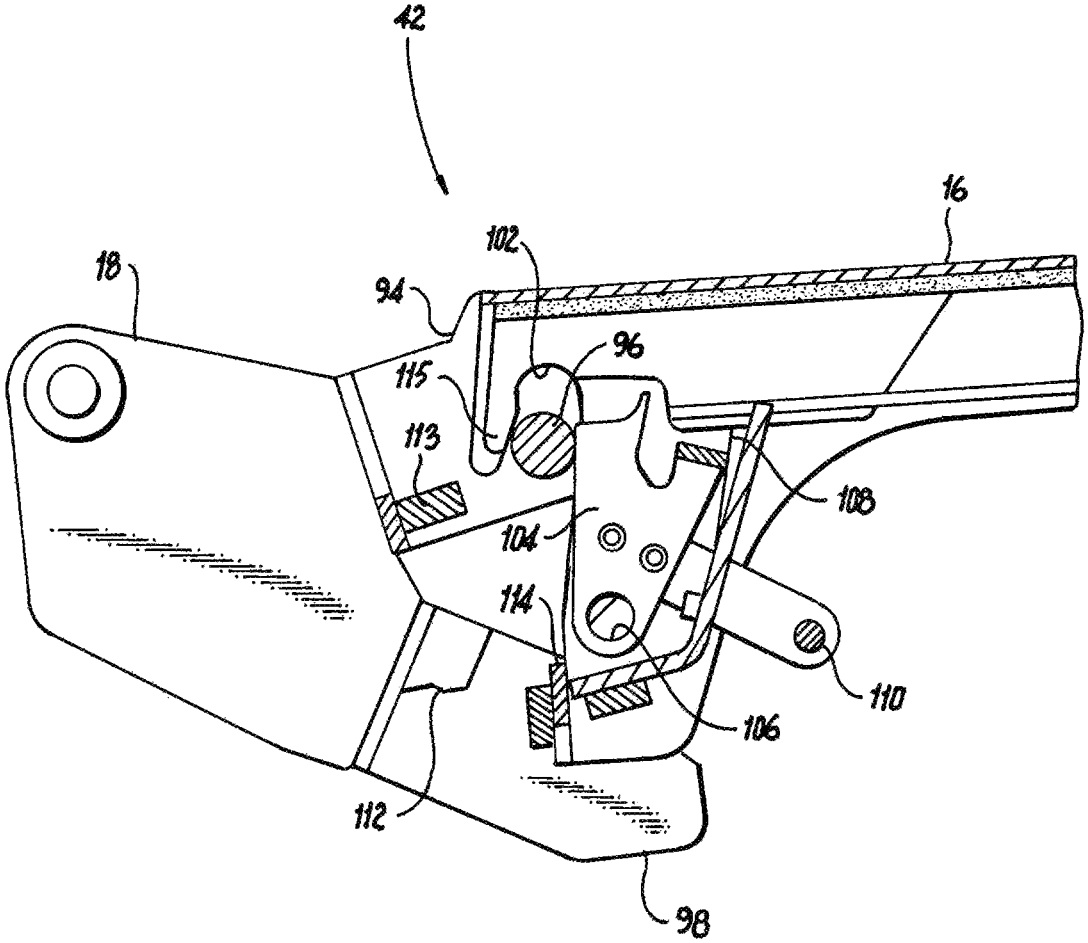
FIG. 14 is a cross-sectional view similar to that of FIG. 13, showing the connection member and adapter in an initial mating stage wherein a crossbar of the adapter is being received by the connection member.
Figure 15:
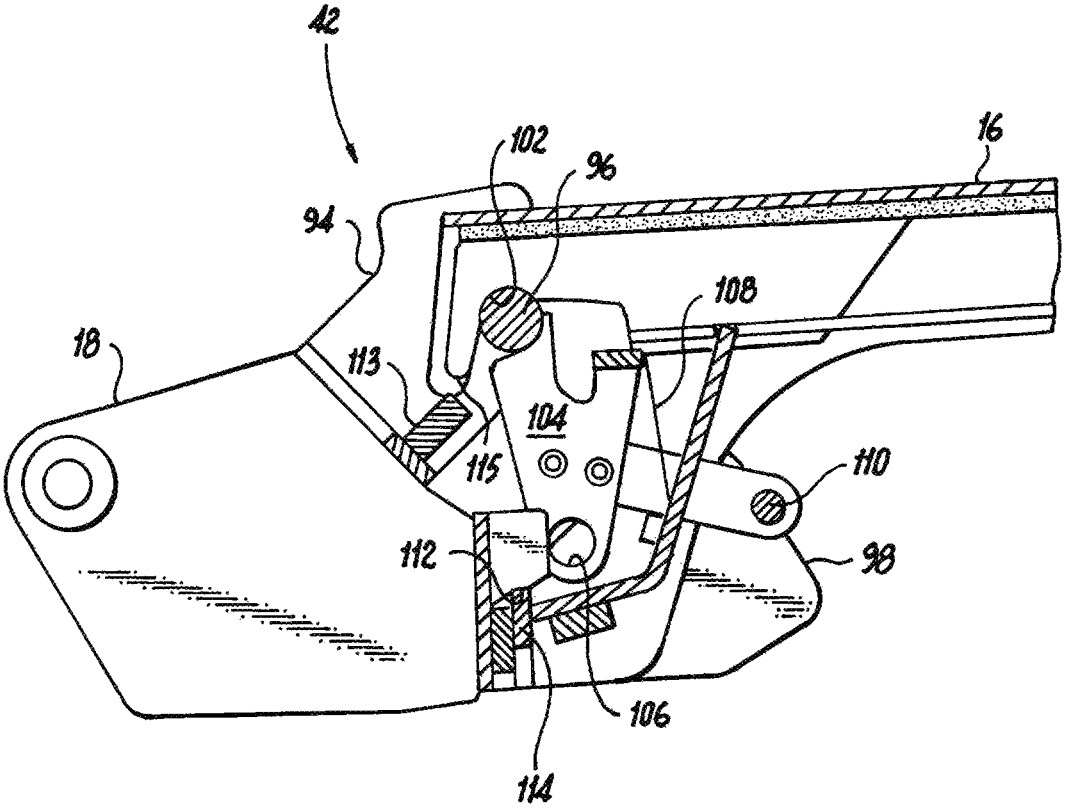
FIG. 15 is a cross-sectional view similar to that of FIG. 13, showing the connection member and adapter in a fully mated condition wherein a latch of the connection member is actuated to secure the coupling.

Latch 104 pivots relative to sidewalls 100, and a spring 108 is arranged to bias latch 104 toward a closed position relative to mouth regions 102 as shown in FIG. 13. In the illustrated embodiment, spring 108 is a leaf spring having a first end fixed to connection member 16 and a second end engaging latch 104. Latch 104 is configured to pivot about pivot axis 106A against the bias of spring 108 toward an open position as crossbar 96 is inserted into mouth regions 102 as depicted in FIG. 14. Once crossbar 96 is fully inserted into mouth regions 102 as shown in FIG. 15, latch 104 is biased by spring 108 to return to its closed position to retain crossbar 96 in mouth regions 102.

Latch 104 has a transverse retainer bar 110 spaced from pivot axis 106A. When crossbar 96 is received by mouth regions 102 and latch 104 is in the closed position, retainer bar 110 is arranged to engage the lower side flanges 98 of adapter 18 to prevent rotation of connection member 16 relative to adapter 18 in a downward rotational direction about crossbar 96 and to prevent pivotal motion of latch 104 about pivot axis 106A toward the open position. In the depicted embodiment, lower side flanges 98 include recesses 99 for receiving retainer bar 110. As may be seen, the second end of leaf spring 108 may engage latch 104 at a location spaced from retainer bar 110.

Adapter 18 may further include a downwardly facing catch surface 112 and coupling portion 42 may further include an upwardly facing catch surface 114, such that when crossbar 96 is received by mouth regions 102 and latch 104 is in the closed position, upwardly facing catch surface 114 is arranged to engage downwardly facing catch surface 112 to prevent rotation of connection member 16 relative to adapter 18 in a downward rotational direction about crossbar 96.

Adapter 18 may also include a detent member 113 arranged between upper side flanges 94, and the distal end of coupling portion 42 may include a pair of projections 115, such that when crossbar 96 is received by mouth regions 102 and latch 104 is in the closed position, rotation of connection member 16 relative to adapter 18 in an upward rotational direction about crossbar 96 is limited by engagement of projections 115 against detent member 113.

As may be appreciated, the engagement of retainer bar 110 of latch 104 with lower side flanges 98, the engagement of catch surfaces 112, 114 with one another, and the engagement of projections 115 with detent member 113 act to prevent inadvertent uncoupling when basket apparatus 10 is raised and supported in cantilevered fashion by crane boom 2.

Attention is once again directed to FIGS. 1-3. Foldable rail assembly 20 is removably mountable on at least one of the spine 12 and the support platform 14. As shown in the illustrated embodiment, foldable rail assembly 20 may include a first foldable rail portion 20A and a second foldable rail portion 20B. Folding may be provided by vertical piano hinges 21. Each of the first and second foldable rail portions 20A, 20B may have one end mountable on spine 12 and another end coupled to the other foldable rail portion 20A or 20B. For example, each rail portion 20A, 20B may have a radially-stepped coupler plug 118 located for slidable receipt in a corresponding keyway 120 in bottom spine segment 12A and a spring-loaded latch bar 122 that releasably mates with a corresponding opening 124 in middle spine segment 12B to mount the rail portion on spine 12. One of the rail portions 20A, 20B may include a pivotable clip 126 for releasably grasping an adjacent member of the other rail portion at a location opposite to where the rail portions are mounted on spine 12 to thereby couple the rail portions to one another. As mentioned above, support posts 38 of support platform 14 are selectively foldable to a vertical orientation wherein the support posts provide support at the hinged corners of foldable rail portions 20A, 20B.

Figure 4A:
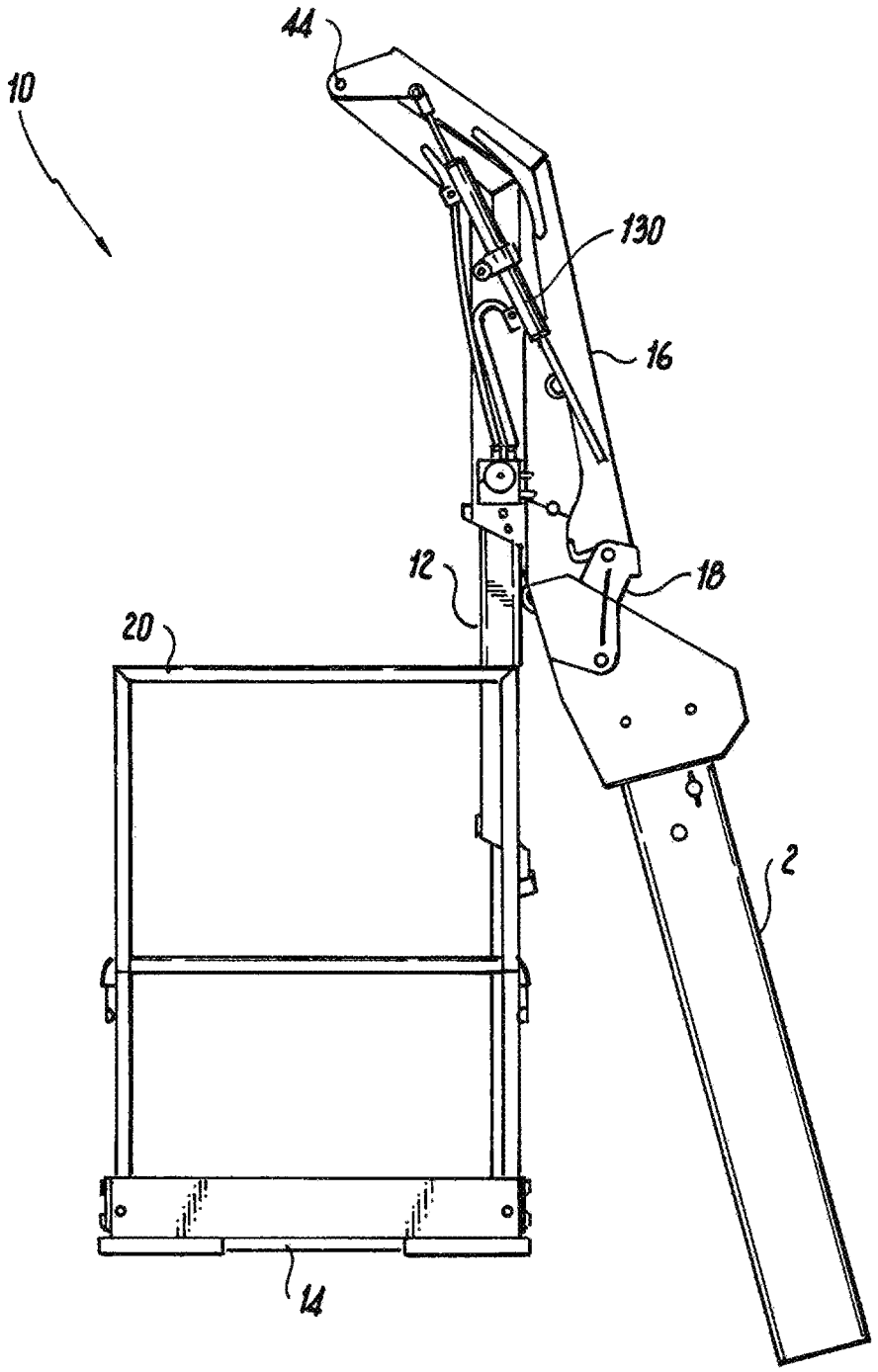
FIGS. 4A-4C are a series of side views showing the personnel basket apparatus mounted on a crane boom, wherein the crane boom is shown at a lower elevation angle limit (FIG. 4A), an intermediate elevation angle (FIG. 4B), and an upper elevation angle limit (FIG. 4C)
Figure 4B:
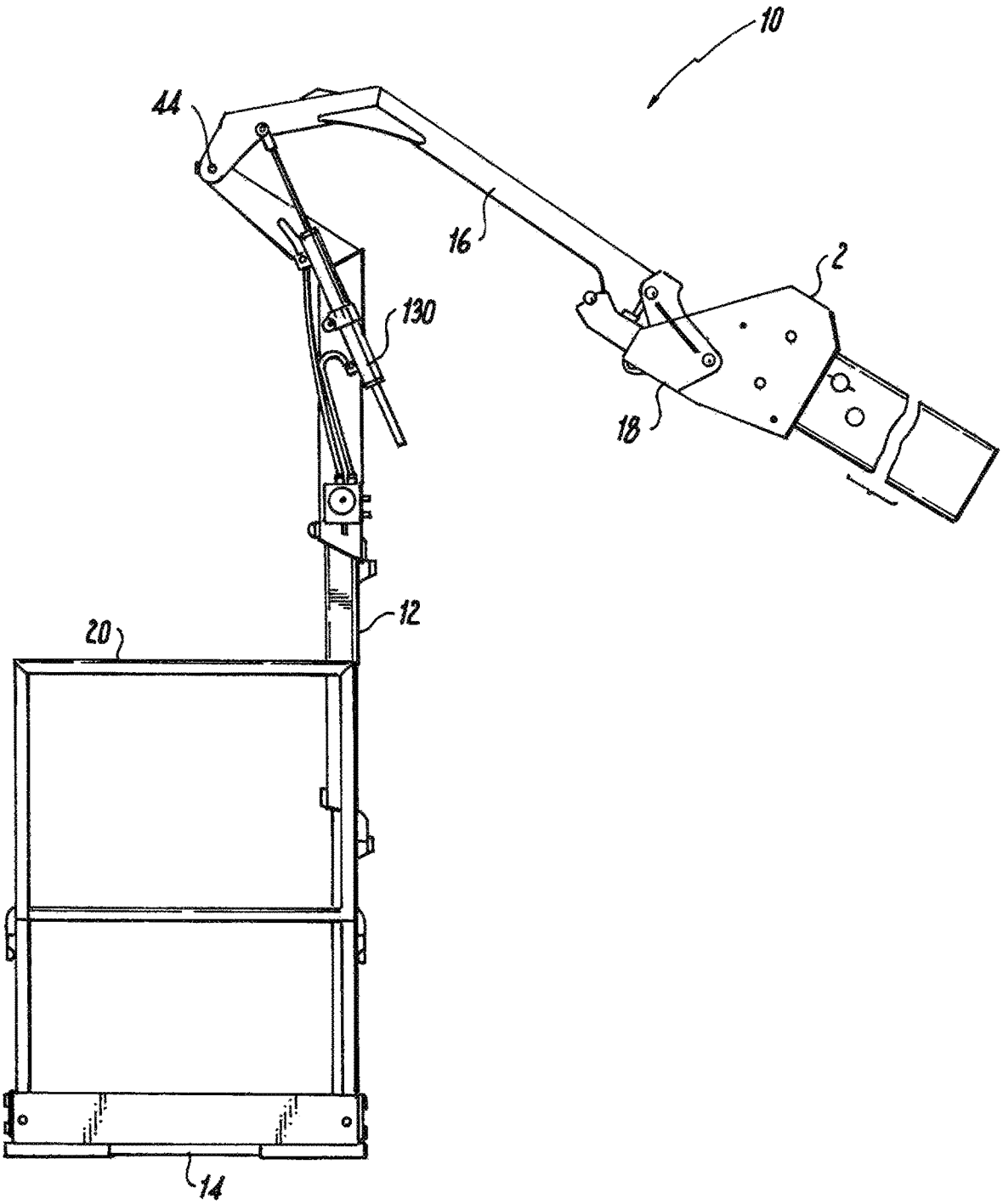
Figure 4C:
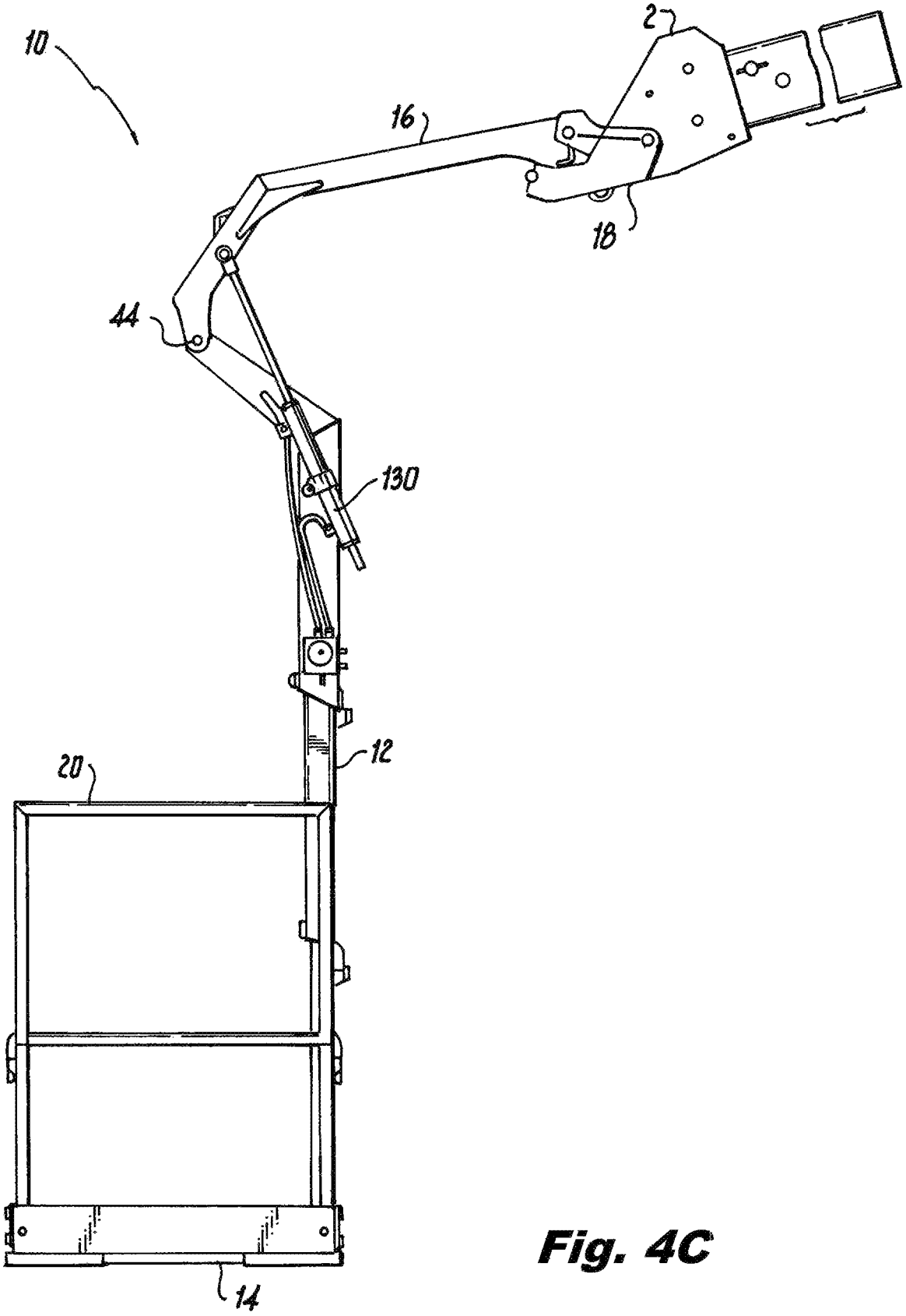

With reference to FIGS. 4A-4C, it will be seen that spine 12 of basket apparatus 10 remains in a vertical orientation throughout various elevation angles of crane boom 2 due to the rotation of spine 12 relative to connection member 16 at rotational journal 44. In order to dampen oscillation and prevent unwanted swinging of spine 12 and dependent support platform 14 relative to connection member 16 when the elevation angle of boom 2 is adjusted, a damper mechanism 130 may be arranged to act between spine 12 and connection member 16. In the depicted embodiment, damper mechanism 130 is arranged to act between top spine segment 12 and connection member 16, however damper mechanism 130 may be coupled to a different spine segment. Damper mechanism 130 is illustrated as being an adjustable-stiffness hydraulic damper mechanism, however other types of damper mechanisms may be employed.

Figure 16:
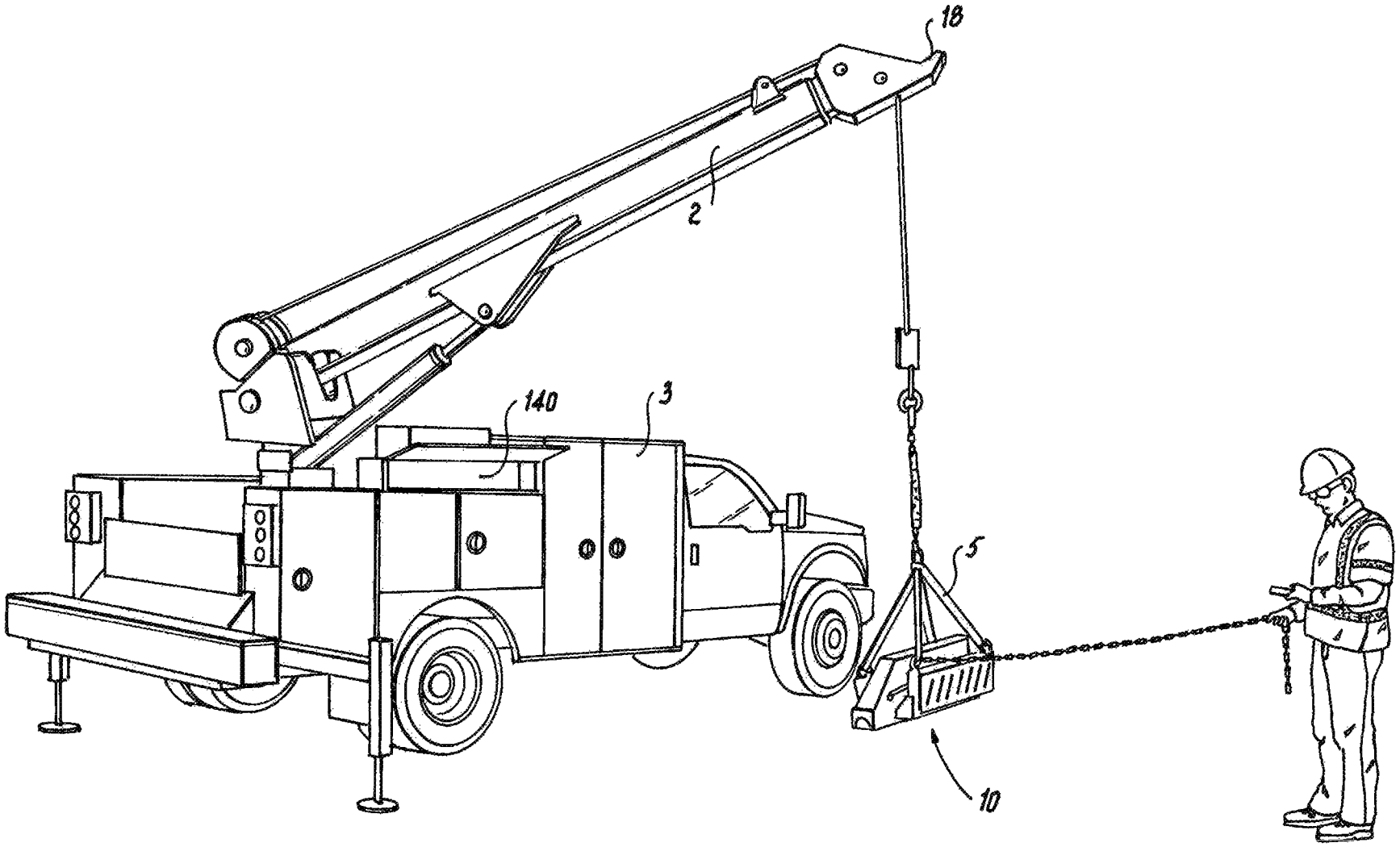
FIGS. 16-19 are a series of perspective views illustrating a method of setting up a personnel basket in accordance with an embodiment of the present invention.
Figure 20:
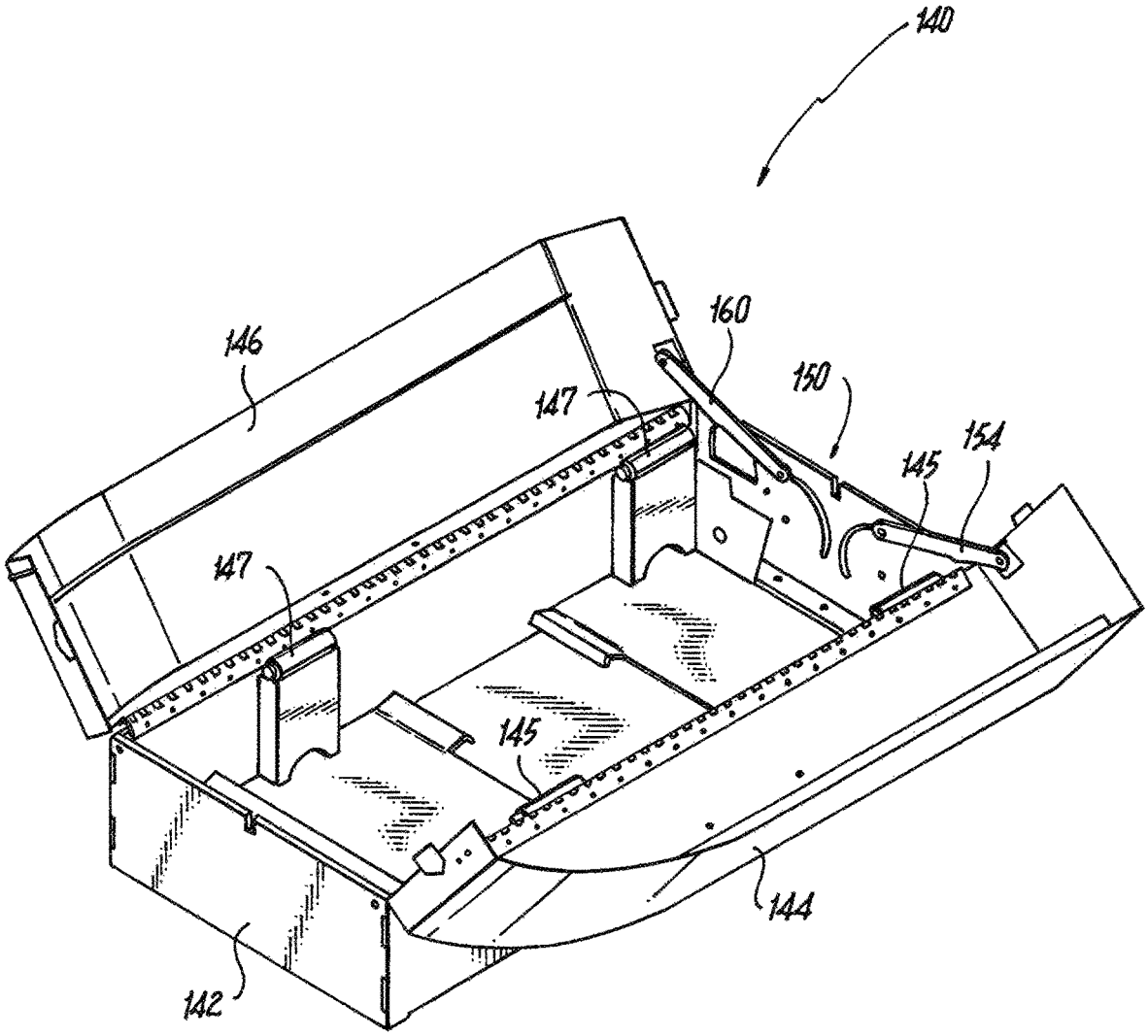
FIG. 20 is a perspective view of a storage apparatus for storing the personnel basket apparatus shown in FIGS. 1-3, wherein the storage apparatus is shown in an opened condition.
Figure 21:
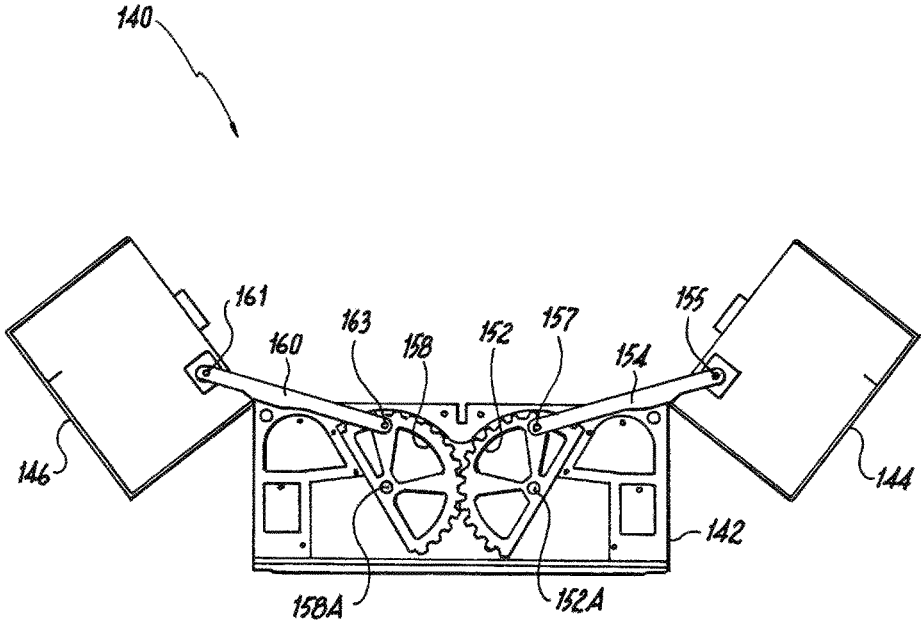
FIG. 21 is a cross-sectional view of the storage apparatus shown in FIG. 20, showing a mechanical transmission thereof.

In another aspect of the present invention, a storage apparatus 140 shown in FIGS. 20 and 21 is provided for storing spine 12, support platform 14, and connection member 16 when these components are in their compact storage position shown in FIG. 3. As illustrated in FIG. 16, storage apparatus 140 is designed to be mounted on a utility crane truck 3. Storage apparatus 140 is designed to opened and closed by a person standing at the side of the truck 3, without the need to climb up onto the truck bed. Storage apparatus 140 generally comprises a container 142 defining an internal compartment and an access opening for allowing access to the internal compartment, a primary cover 144, and a secondary cover 146. Container 142 may be fastened at a fixed position on truck 3.

Primary cover 144 is mounted on container 142, for example by hinges 145, to move relative to the container between a closed position wherein the primary cover 144 closes a first portion of the access opening and an open position, shown in FIG. 20, wherein the primary cover 144 does not close the first portion of the access opening. Likewise, secondary cover 146 is mounted on container 142, for example by hinges 147, to move relative to the container between a closed position in which the secondary cover closes a second portion of the access opening and an open position in which the secondary cover does not close the second portion of the access opening. Storage apparatus 140 further comprises a transmission 150 mechanically connecting primary cover 144 to secondary cover 146, wherein motion of primary cover 144 from its closed position to its open position moves secondary cover 146 from its closed position to its open position, and wherein motion of primary cover 144 from its open position to its closed position moves secondary cover 146 from its open position to its closed position. As shown in FIGS. 20 and 21, transmission 150 may include a first gear 152 mounted on container 142 for rotation about a first gear axis 152A, a first link rod 154 having a first end 155 pivotally coupled to primary cover 144 and a second end 157 pivotally coupled to first gear 152 at a location spaced from first gear axis 152A, a second gear 158 mounted on container 142 for rotation about a second gear axis 158A and mated with first gear 152, and a second link rod 160 having a first end 161 pivotally coupled to secondary cover 146 and a second end 163 pivotally coupled to second gear 158 at a location spaced from second gear axis 158A. As may be understood, when primary cover 144 is swung open by a user, first link rod 154 imparts rotational motion to first gear 152, which in turn imparts rotational motion to second gear 158, thereby causing second link rod 160 to push secondary cover 146 open. Conversely, when primary cover 144 is closed by a user, transmission 150 causes secondary cover 146 to close in reverse manner.

A method of setting up and connecting basket apparatus 10 to crane boom 2 will now be described with reference to FIGS. 16-19 and FIGS. 13-15. As shown in FIG. 16, a spine assembly comprising spine 12, support platform 14, and connection member 16 is lifted from a opened storage apparatus 140 and placed onto a support surface, which may be the ground, a roadway, a floor structure, or some other surface. As may be seen, the spine assembly is in its collapsed storage position also illustrated in FIG. 3. Crane boom 2 may be used to lift and place the spine assembly by attaching a harness 5 to the crane cable and coupling harness 5 to the spine assembly at eyelets 35.

Figure 17:
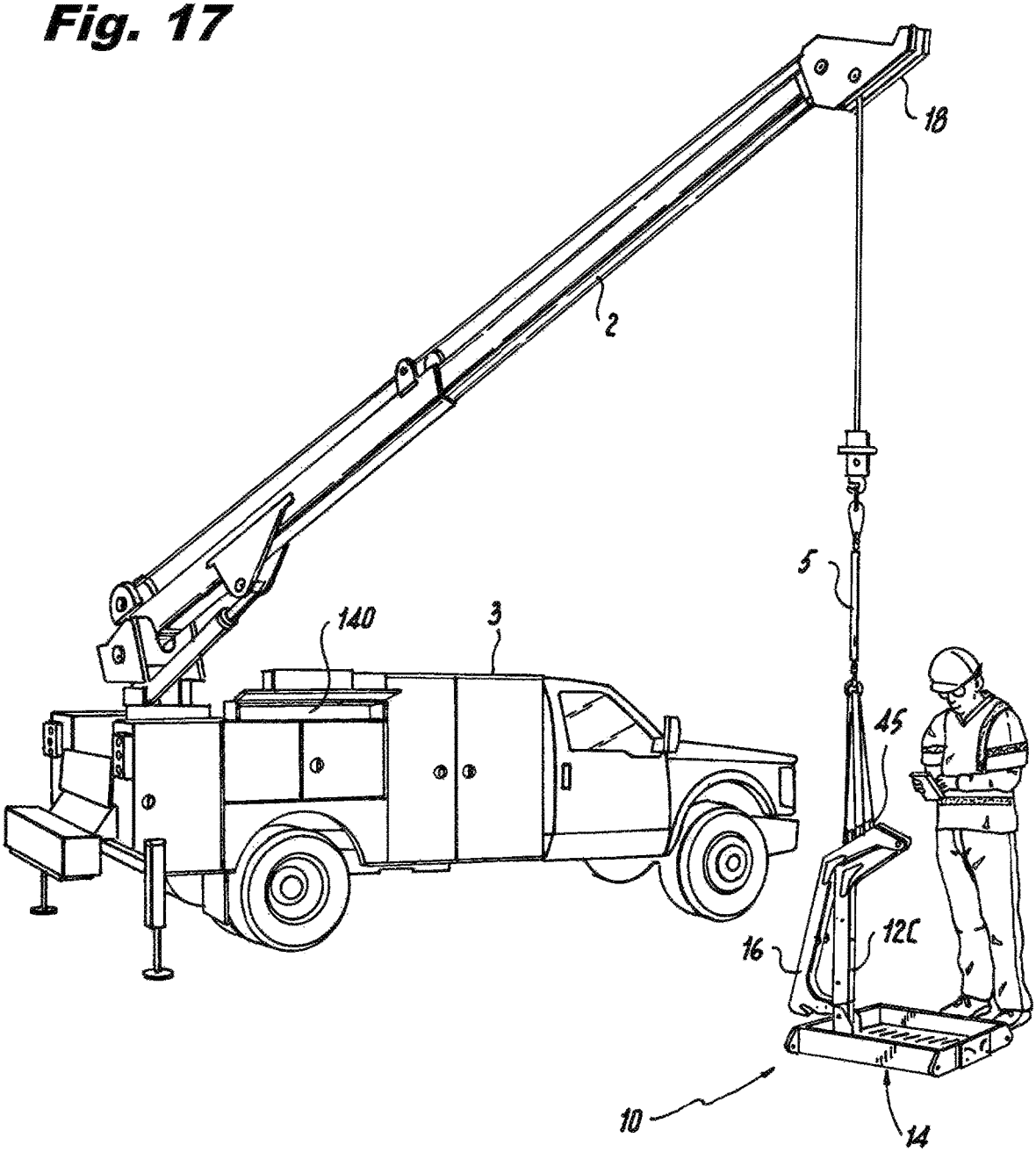
Figure 18:
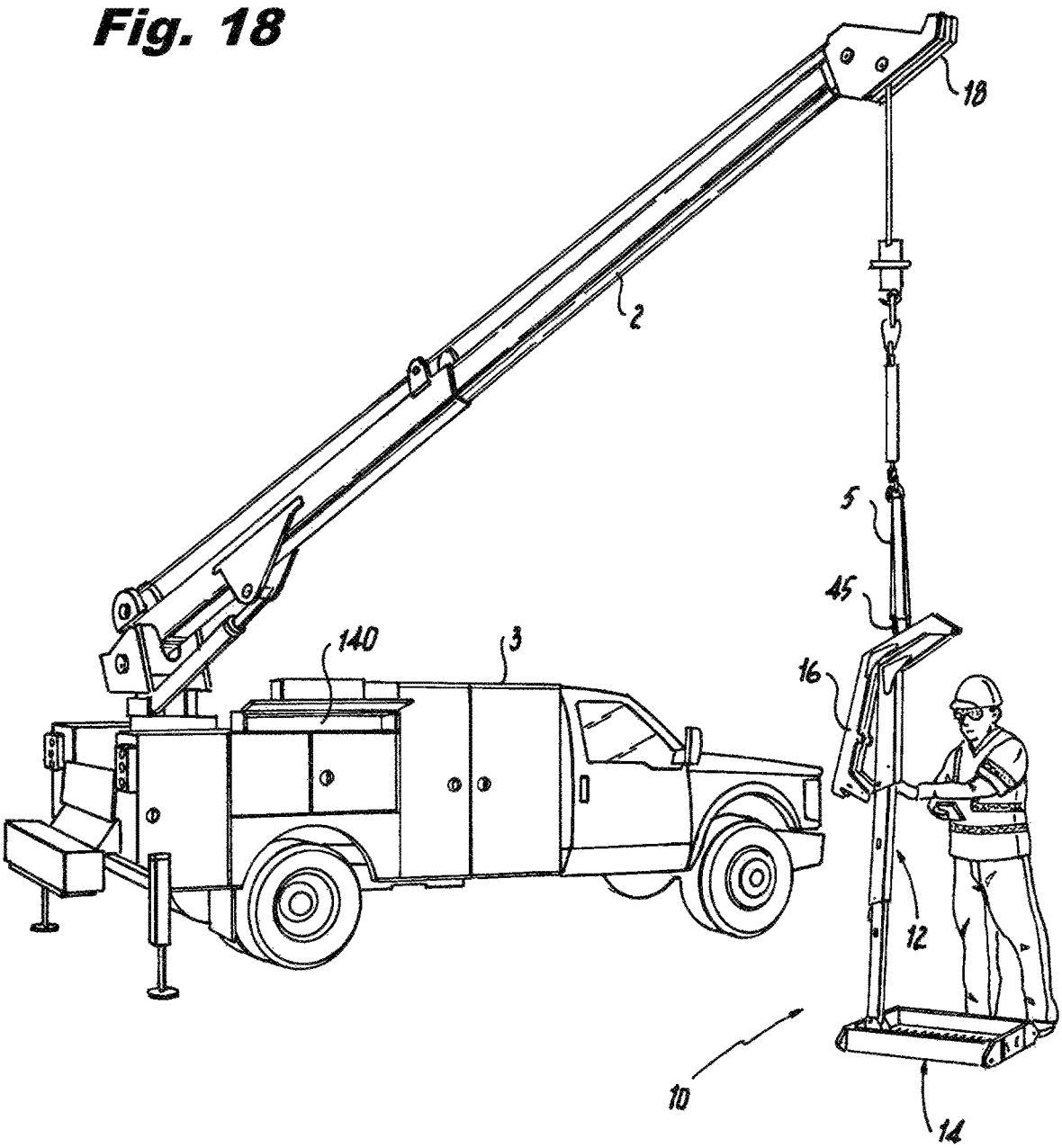

As shown in FIGS. 17 and 18, the crane may then used to adjust the spine assembly from the storage position to an extended deployment position. Harness 5 is released from the spine assembly except for connection of the harness at eyelet 45 on connection member 16, and the crane cable is spooled to pull upwardly on connecting member 16. As may be seen in FIG. 17, bottom spine segment 12A pivots up to a vertical position. The spine locking mechanism 50 between bottom spine segment 12A and middle spine segment 12B may be adjusted to the "set-up" position such that as middle spine segment 12B slides up relative to bottom spine segment 12A, plunger 60 on the middle spine segment is biased to engage with shaped feature 56 on the bottom spine segment upon mutual alignment to hold the spine segments 12A, 12B in extended relation. FIG. 18 shows a similar adjustment step extending top spine segment 12C relative to middle spine segment 12B as the crane cable continues pulling upwardly on connection member 16. As will be understood from FIGS. 17 and 18, eyelet 45 on connection member 16 is arranged to be in alignment with the vertical axis of spine 12. Once the spine 12 is fully extended, the locking mechanisms 50 may be set to the fully locked position.

Figure 19:
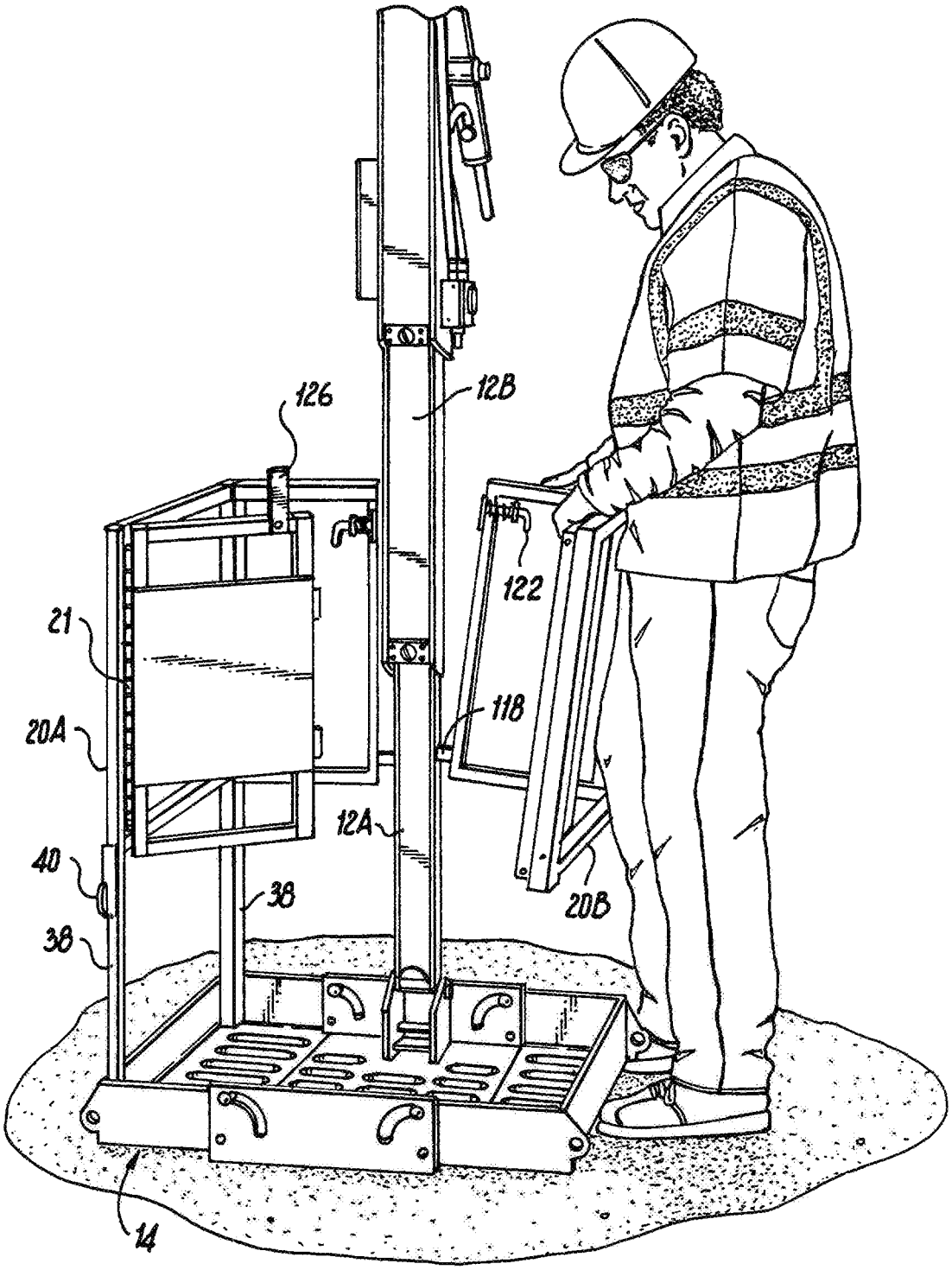

The next step in deployment of basket apparatus 10, shown in FIG. 19, is attaching rail assembly 20 to the spine assembly, for example at spine 12 and/or support platform 14. In the disclosed embodiment, each rail portion 20A, 20B is manually unfolded and mounted on spine 12 by inserting coupler plug 118 into keyway 120 and inserting latch bar 122 into opening 124. The two rail portions 20A, 20B are then coupled to one another using clip 126. Support posts 38 may be folded up from support platform 14 and coupled to the corners of rail portions 20A, 20B using toggle clips 40.

The spine assembly is then coupled to the boom tip of the crane using the coupling apparatus provided by coupling portion 42 of connection member 16 and adapter 18 on the boom tip, as described above with reference to FIGS. 13-15. Harness 5 may be removed from the spine assembly and the crane cable may be fully retracted in preparation for coupling. The crane boom 2 is then tilted down so that adapter 18 at the tip of the crane boom is approximately at the height of the coupling portion 42, whereby coupling may be manually guided by a user in accordance with the progression depicted in FIGS. 13-15.

When it is time to collapse and store basket apparatus 10 after use, the crane boom is tilted down to set basket apparatus 10 on the ground, and coupling portion 42 may be released from mating engagement with adapter 18. Latch 104 may be manually pulled toward its open position, and connection member 16 may be tilted up such that crossbar 96 is withdrawn from mouth regions 102, at which point the latch may be allowed to return to its closed position under spring bias. The boom may be withdrawn out of the way, and connection member 16 may then be allowed to rotate down to overlap top spine segment 12C. Rail portions 20A and 20B may then be manually removed from the spine assembly and folded for storage on truck 3.

Harness 5 may be reconnected to eyelet 45. As a safety feature, locking mechanism 50 resists adjustment out of the "locked" position when spine segments 12A, 12B, and 12C are in compression. Thus, in order to unlock the spine segments to permit telescoping collapse, the spine segments must be placed in tension using the crane cable, which may be attached again to act through harness 5 and connection member 16. As may be understood, if a user were allowed to freely unlock the spine segments while the spine segment are in compression, the dog-leg portion of top spine segment 12C would potentially come down on the user's head if the user is not prepared. By requiring tension in spine 12 as a prerequisite to unlocking the spine segments, this risk is mitigated and a controlled collapse of the spine segments is dictated. With tension applied to spine 12, locking mechanisms 50 are unlocked and the spine segments are allowed to collapse onto one another as the crane cable is slowly extended. Connection member 16, collapsed spine 12, and support platform 14 may then be folded into the storage position illustrated in FIG. 3. Harness 5 may be uncoupled from eyelet 45 and connected to eyelets 35 so that the spine assembly can be hoisted using the crane and placed back into storage apparatus 140. As described above, storage apparatus 140 may be closed by a user standing at the side of truck 3 merely by closing the primary cover 144 that is within reach, whereby the secondary cover 146 that is more difficult to reach is closed as a result of closing the primary cover.

While the invention has been described in connection with exemplary embodiments, the detailed description is not intended to limit the scope of the invention to the particular forms set forth. As one example, the described embodiment is shown as supporting a single user, however the invention may be embodied by an apparatus that supports more than one user. The invention is intended to cover such alternatives, modifications and equivalents of the described embodiments as may be included within the scope of the appended patent claims.

What is claimed is:

1. A personnel basket apparatus for attachment to a boom of a crane, the apparatus comprising:

a spine including a plurality of elongated spine segments adjustable between a spine storage position wherein the plurality of spine segments overlap one another and a spine deployment position wherein the plurality of spine segments are arranged end-to-end with one another, the plurality of spine segments including a bottom spine segment and top spine segment;

a support platform pivotally coupled to the bottom spine segment to rotate relative to the bottom spine segment between a platform storage position wherein the platform is folded toward the bottom spine segment and a platform deployment position wherein the platform is substantially perpendicular to the bottom spine segment;

a connection member including a proximal end and a distal end, the proximal end having a coupling portion and the distal end being pivotally coupled to the top spine segment to rotate relative to the top spine segment;

an adapter configured for attachment to a crane tip at a distal end of a crane boom, wherein the adapter mates with the coupling portion of the connection member to removably mount the connection member on the crane tip; and a foldable rail assembly removably mountable on at least one of the spine and the support platform.

2. The personnel basket apparatus according to claim 1, wherein the plurality of spine segments are telescopically adjustable between the spine storage position and the spine deployment position.

3. The personnel basket apparatus according to claim 1, wherein the support platform comprises a plurality of platform portions hingedly connected to one another, wherein the platform portions are folded relative to one another when the platform is in the platform storage position and the platform portions are unfolded relative to one another when the platform is in the platform deployment position.

4. The personnel basket apparatus according to claim 3, wherein the plurality of platform portions includes a central platform portion pivotally coupled to the bottom spine segment and a pair of lateral platform portions hingedly coupled to the central platform portion on opposite sides thereof, wherein the lateral platform portions are each pivotable relative to the central platform portion.

5. The personnel basket apparatus according to claim 1, wherein the support platform includes a plurality of support posts on which the foldable rail assembly is removably mountable, wherein each of the plurality of support posts is foldable from a horizontal storage position to a vertical deployment position wherein the support posts provide support for the foldable rail assembly.

6. The personnel basket apparatus according to claim 1, wherein the foldable rail assembly includes a first foldable rail portion and a second foldable rail portion, each of the first and second foldable rail portions having one end mountable on the spine and another end coupled to the other foldable rail portion.

7. The personnel basket apparatus according to claim 1, further comprising a damper mechanism arranged to dampen rotational motion between the top spine segment and the connection member.

8. The personnel basket apparatus according to claim 7, wherein the damper mechanism is an adjustable-stiffness damper mechanism.

9. A method of setting up and connecting a personnel basket of claim 1 to a crane, the method comprising the steps of:

placing a spine assembly of the personnel basket onto a support surface, wherein the spine assembly is in a collapsed storage position;

using the crane to adjust the spine assembly from the storage position to an extended deployment position;

attaching a rail assembly of the personnel basket to the spine assembly; and coupling the spine assembly to a boom tip of the crane.

10. The method according to claim 9, wherein the step of placing the spine assembly onto the support surface includes using the crane to lift the spine assembly and deliver the spine assembly onto the support surface.

11. The method according to claim 9, wherein the step of using the crane to adjust the spine assembly from the storage position to an extended deployment position includes hoisting a member of the spine assembly in an upward direction to telescopically extend an upper spine segment of the spine assembly relative to a lower spine segment of the spine assembly.

12. The method according to claim 9, wherein the step of attaching the rail assembly to the spine assembly is performed manually.

13. The method according to claim 9, wherein the step of attaching the rail assembly to the spine assembly includes unfolding at least one rail subassembly.

14. A coupling apparatus in combination the personnel basket of claim 1 comprising:

an adapter configured to be fastened to a crane boom tip, the adapter including an upper pair of side flanges and a crossbar extending transversely between the upper pair of side flanges, and the adapter including a lower pair of side flanges;

a connection member including a pair of sidewalls each having an open mouth region sized to receive the crossbar, a latch mounted between the pair of sidewalls for pivotal motion about a transverse pivot axis relative to the pair of sidewalls, and a spring arranged to bias the latch toward a closed position relative to the mouth regions of the pair of sidewalls;

wherein the latch is configured to pivot about the pivot axis toward an open position to allow the crossbar to be inserted into the pair of mouth regions, and the latch is biased by the spring to return to the closed position when the crossbar is received by the pair of mouth regions;

wherein the latch has a transverse retainer bar spaced from the pivot axis;

wherein when the crossbar is received by the pair of mouth regions and the latch is in the closed position, the retainer bar is arranged to engage the lower pair of side flanges of the adapter to prevent rotation of the connection member relative to the adapter in a downward rotational direction about the crossbar and to prevent pivotal motion of the latch about the pivot axis toward the open position.

15. The coupling apparatus according to claim 14, wherein the adapter further includes a downwardly facing catch surface and the connection member further includes an upwardly facing catch surface, wherein when the crossbar is received by the pair of mouth regions and the latch is in the closed position, the upwardly facing catch surface of the connection member is arranged to engage the downwardly facing catch surface of the adapter to prevent rotation of the connection member relative to the adapter in a downward rotational direction about the crossbar.

16. The coupling apparatus according to claim 14, where in the adapter further includes a detent member arranged between the pair of upper side flanges, and the connection member further includes at least one projection arranged such that when the crossbar is received by the mouth regions and the latch is in the closed position, rotation of the connection member relative to the adapter in an upward rotational direction about the crossbar is limited by engagement of the at least one projection against the detent member.

17. The coupling apparatus according to claim 14, wherein the spring is a leaf spring having a first end fixed to the connection member and a second end engaging the latch.

18. The coupling apparatus according to claim 17, wherein the second end of the leaf spring engages the latch at a location spaced from the retainer bar.

* * * * *